US007404384B2

(12) United States Patent
Kido et al.

(10) Patent No.: US 7,404,384 B2
(45) Date of Patent: Jul. 29, 2008

(54) VARIABLE VALVE DEVICE FOR INTERNAL COMBUSTION ENGINE

(75) Inventors: Yusuke Kido, Okazaki (JP); Shinichi Murata, Okazaki (JP); Masaru Mori, Nogoya (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/727,633

(22) Filed: Mar. 27, 2007

(65) Prior Publication Data

US 2007/0227481 A1 Oct. 4, 2007

(30) Foreign Application Priority Data

Mar. 28, 2006 (JP) ..... 2006-089144
Mar. 28, 2006 (JP) ..... 2006-089145

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39, 90.27, 90.31
See application file for complete search history.

(56) References Cited

U.S. PATENT DOCUMENTS 4,535,732 A * 8/1985 Nakano et al. ..... 123/90.16

FOREIGN PATENT DOCUMENTS

JP 2005-90408 A 4/2005

* cited by examiner

*Primary Examiner*—Zelalem Eshete
(74) *Attorney, Agent, or Firm*—Birch, Stewart, Kolasch, Stewart, LLP

(57) ABSTRACT

A variable valve device for an internal combustion engine comprises a first switching oil passage which is formed along an axial direction in one of a rocker shafts, the first rocker arm being switched to the first mode by applying oil pressure to a first rocker arm through the first switching oil passage, and a second switching oil passage which is formed along an axial direction in the other rocker shaft, a second rocker arm being switched to the first mode by applying oil pressure to the second rocker arm through the second switching oil passage. The first switching oil passage and the second switching oil passage are formed in a ladder shape in which the first switching oil passage and the second switching oil passage communicate via a plurality of relay oil passages.

8 Claims, 13 Drawing Sheets

VARIABLE VALVE DEVICE FOR INTERNAL COMBUSTION ENGINE

CROSS-REFERENCE TO RELATED APPLICATIONS

This application is based upon and claims the benefit of priority from prior Japanese Patent Applications No. 2006-089144, filed Mar. 28, 2006; and No. 2006-089145, filed Mar. 28, 2006, the entire contents of both of which are incorporated herein by reference.

BACKGROUND OF THE INVENTION

1. Field of the Invention

The present invention relates to a variable valve device for an internal combustion engine in which at least one kind of switching oil passages are provided in a pair of rocker shafts while oil pressure of the switching oil passage of one of the rocker shafts is introduced to the switching oil passage of the other rocker shaft to switch rocker arms located in the rocker shafts at the same time.

2. Description of the Related Art

The engine which is switched from a normal state to a high-speed mode or a cylinder suspension mode using the variable valve device with the rocker arm is being developed to balance improvement of output characteristics and reduction of fuel consumption in an automobile-mounted reciprocating engine (internal combustion engine). When the engine enters a high engine revolution speed range, the engine is switched to the high-speed mode suitable to the high engine revolution speed range. The engine is switched to the cylinder suspension mode in which some of cylinders are suspended, when the engine enters a running condition in which large output is not required.

In the cylinder suspension mode, frequently lifts (open and close) of inlet and exhaust valves of the cylinder are stopped to decrease pumping loss. Therefore, in most variable valve devices, the inlet valve is driven by a hydraulic rocker arm which can switch the inlet valve among the normal mode (low-speed mode), the high-speed mode, and the cylinder suspension mode, the exhaust valve is driven by a hydraulic rocker arm which can switch the exhaust valve between the normal mode (low-speed mode) and the cylinder suspension mode, and the rocker arms are driven by the different oil-pressure systems. For example, Jpn. Pat. Appln. KOKAI Publication No. 2005-90408 discloses this kind of technique.

Specifically, as disclosed in Jpn. Pat. Appln. KOKAI Publication No. 2005-90408, in the inlet and exhaust rocker shafts (pair), two kinds of switching oil passages for high-speed mode and cylinder suspension mode are formed in an axial direction in the inlet-side rocker shaft. The switching oil passage for cylinder suspension mode is formed in the axial direction in the exhaust-side rocker shaft.

Further, two oil-pressure systems are used. One oil-pressure system comprises the switching oil passage for cylinder suspension mode of the exhaust-side rocker shaft and the switching oil passage for cylinder suspension mode of the inlet-side rocker shaft. These passages are connected in series. Another oil-pressure system is used for high speed switching.

In the two oil-pressure systems, when the oil pressure does not act on the switching oil passage for high-speed mode and the exhaust-side switching oil passage, the low-speed mode (cam selection suitable to the normal running) is selected in both the inlet-side and exhaust-side rocker arms.

When the oil pressure is applied only to the switching oil passage (for high-speed mode) of the inlet-side rocker shaft, the inlet-side rocker arm is switched to the high-speed mode (cam selection suitable to the high-speed running). When the oil pressure is applied only to the exhaust-side switching oil passage (for cylinder suspension mode), the inlet-side and exhaust-side rocker arms are switched to the cylinder suspension mode (the lift of inlet and exhaust valves is suspended) in which the cam displacement is not transmitted to the valve.

In the variable valve device, because the mode is frequently switched according to the running state of the engine (automobile), there is demanded a performance of rapid mode switching in all the cylinders of the engine within predetermined switching time, i.e., a switching property.

As disclosed in Jpn. Pat. Appln. KOKAI Publication No. 2005-90408, in the system in which the oil pressure is introduced from one of the rocker shafts to the other rocker shaft, a large area of the passage is secured because the exhaust-side switching oil passage for cylinder suspension mode is provided only in the exhaust-side rocker shaft.

However, the inlet-side switching oil passage for cylinder suspension mode is arranged parallel to the switching oil passage for high-speed mode in the inlet-side rocker shaft, so that the area of the passage becomes smaller than that of the exhaust-side switching oil passage for cylinder suspension mode due to a structure.

Therefore, in the structure disclosed in Jpn. Pat. Appln. KOKAI Publication No. 2005-90408, in which the oil pressure is supplied in series from the exhaust-side switching oil passage for cylinder suspension mode to the inlet-side switching oil passage for cylinder suspension mode, although the oil pressure is rapidly delivered to the exhaust-side rocker arm, the oil pressure is prevented from being easily delivered to the inlet-side rocker arm due to the difference in area of the passage.

Therefore, the inlet-side rocker arm, particularly the inlet-side rocker arm located at the end of the oil-pressure system is operated while delayed with respect to the exhaust-side rocker arm (at the start or end of the switching to the cylinder suspension mode).

The delay decreases the switching property during the cylinder suspension mode. Sometimes a switching fluctuation caused by the delay generates a noise and vibration. Furthermore, the influence of the delay narrows a range where the cylinder suspension mode is performed in engine.

SUMMARY OF THE INVENTION

An object of the invention is to provide a variable valve device for internal combustion engine in which a mode switching property is improved.

A variable valve device for an internal combustion engine according to the invention comprises: a camshaft which is rotatably provided in a body of an internal combustion engine; a pair of rocker shafts which is arranged next to the camshaft; an inlet valve which is driven by rotation of the camshaft; an exhaust valve which is driven by the rotation of the camshaft; a first hydraulic rocker arm which is rockably supported by one of the rocker shafts, and is able to switch drive of one of the inlet valve and the exhaust valve at least between a normal drive state and a first mode which is different from the normal drive state; a second hydraulic rocker arm which is rockably supported by the other rocker shaft, and is able to switch drive of the other of the inlet valve and the exhaust valve at least between the normal drive state and the first mode which is different from the normal drive state; a first switching oil passage which is formed along an axial direction in one of the rocker shafts, the first rocker arm being switched to the first mode by applying oil pressure to the first rocker arm through the first switching oil passage; and a second switching oil passage which is formed along an axial direction in the other rocker shaft, the second rocker arm being switched to the first mode by applying oil pressure to the second rocker arm through the second switching oil passage. The first switching oil passage and the second switching oil passage are formed in a ladder shape in which the first switching oil passage and the second switching oil passage communicate via a plurality of relay oil passages.

Accordingly, the oil pressure is rapidly delivered from the switching oil passage formed in one of the rocker shafts to each portion of the switching passage formed in the other rocker shaft by the relay of the relay oil passage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention wherein.

DETAILED DESCRIPTION OF THE INVENTION

A first embodiment of the invention will be described with reference to FIGS. 1 to 19.

Figure 1:
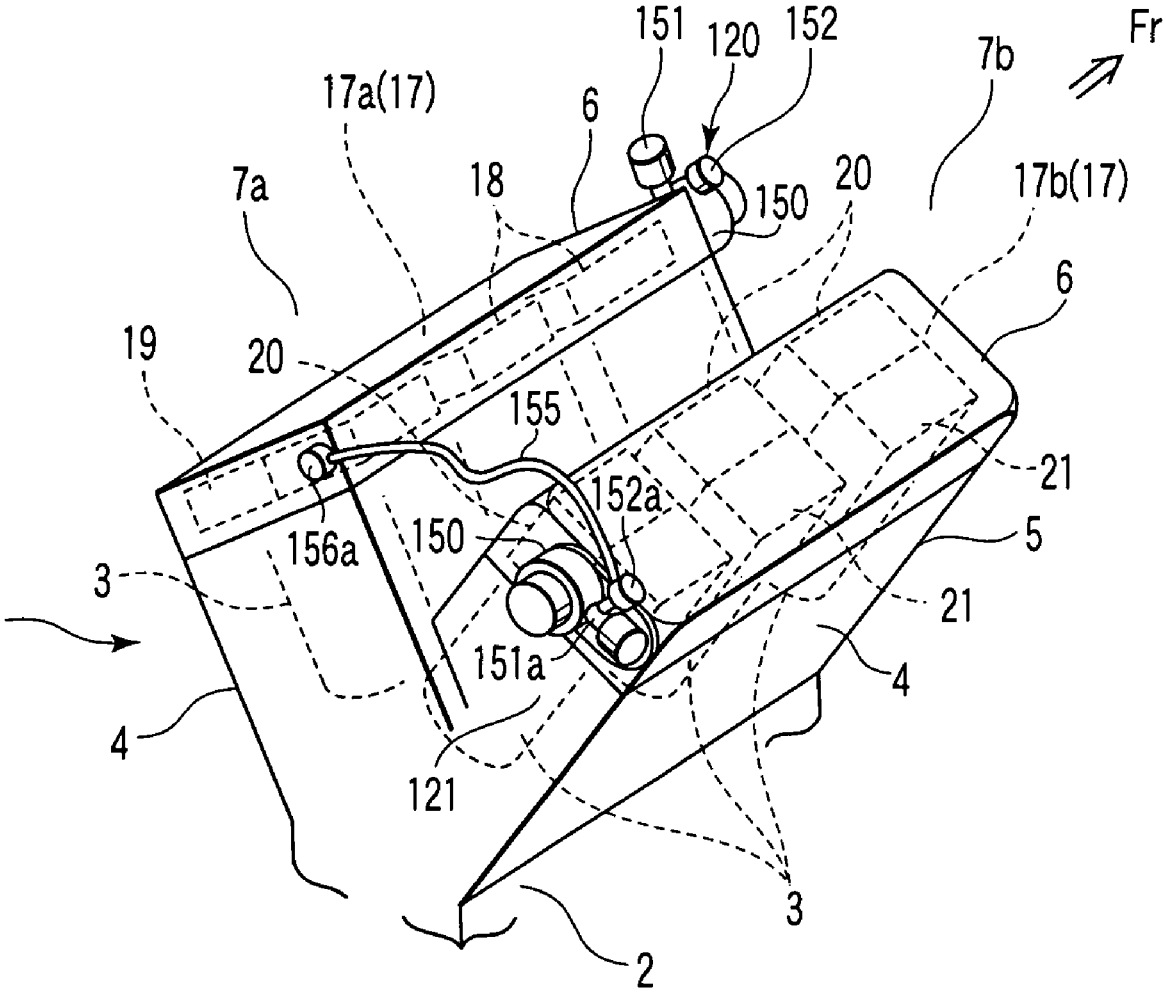
FIG. 1 is a perspective view showing a V-type engine equipped with a variable valve device according to one embodiment of the invention.

FIG. 1 is a perspective view showing an engine (internal combustion engine), e.g., a V-six reciprocating engine (hereinafter simply referred to as V-type engine) when the engine is viewed from behind.

Figure 2:
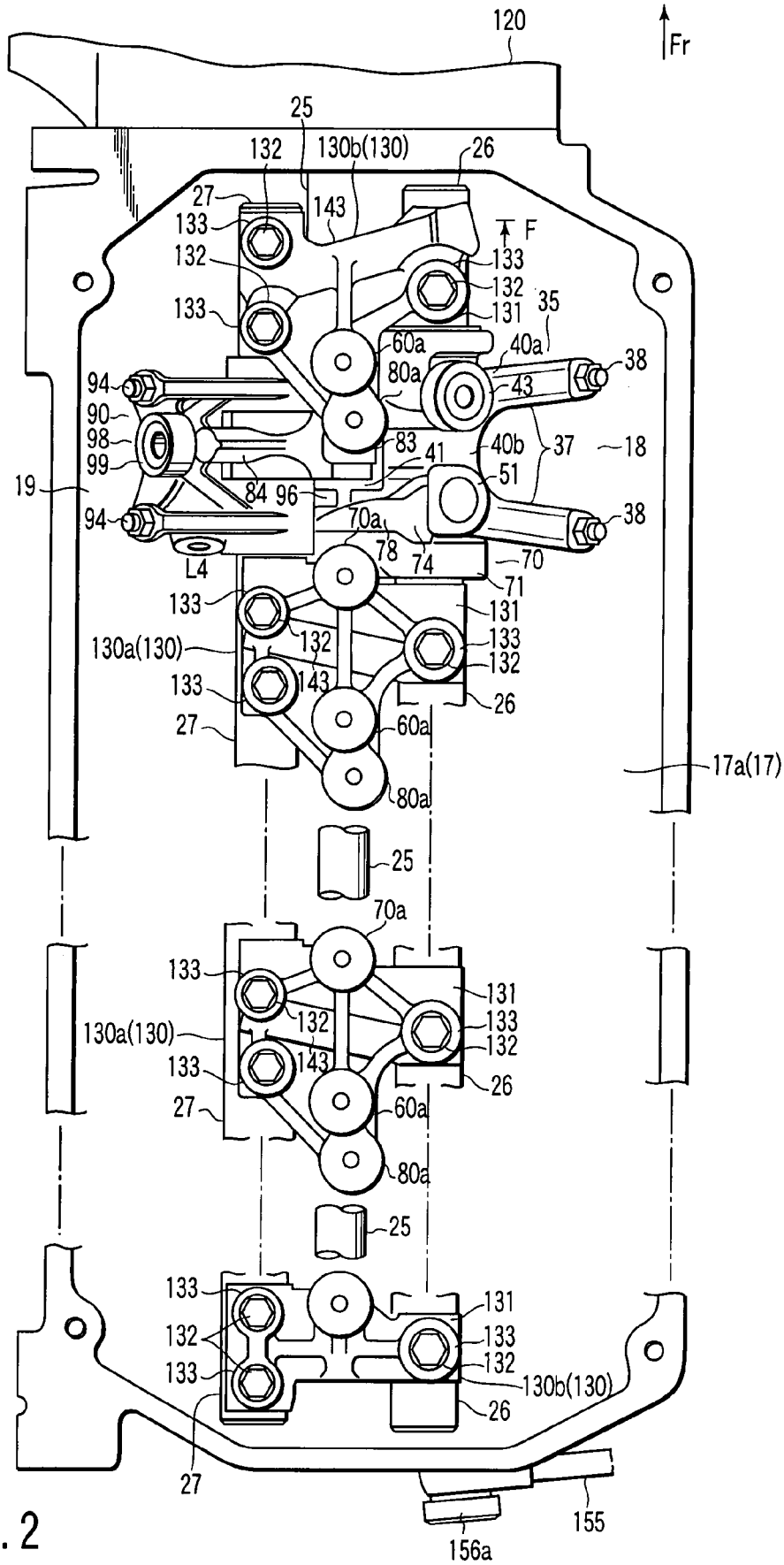
FIG. 2 is a plan view showing a variable valve system of a left bank of the engine.
Figure 3:
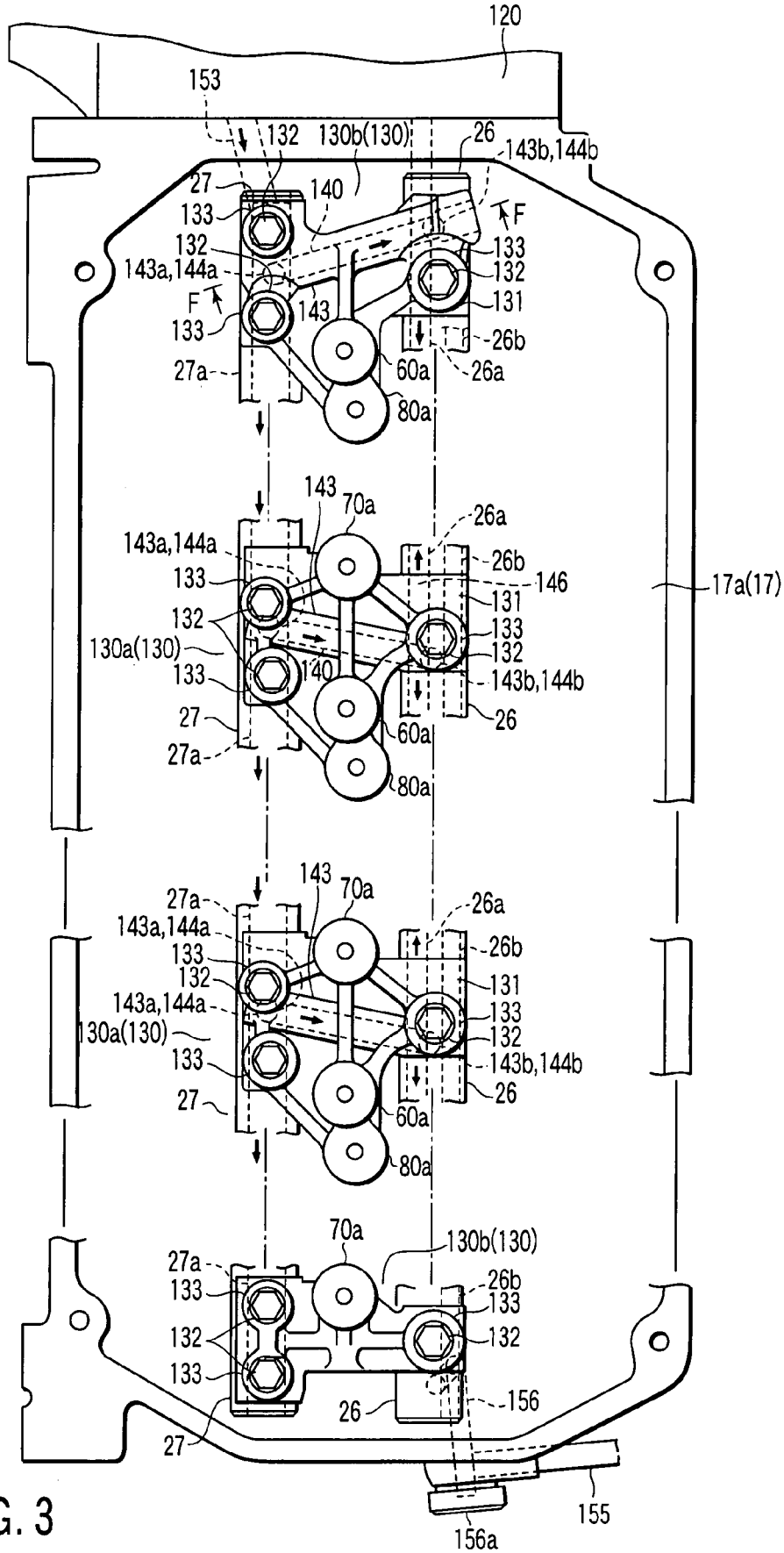
FIG. 3 is a plan view showing a ladder-shaped oil passage of the variable valve device in the variable valve system.
Figure 4:
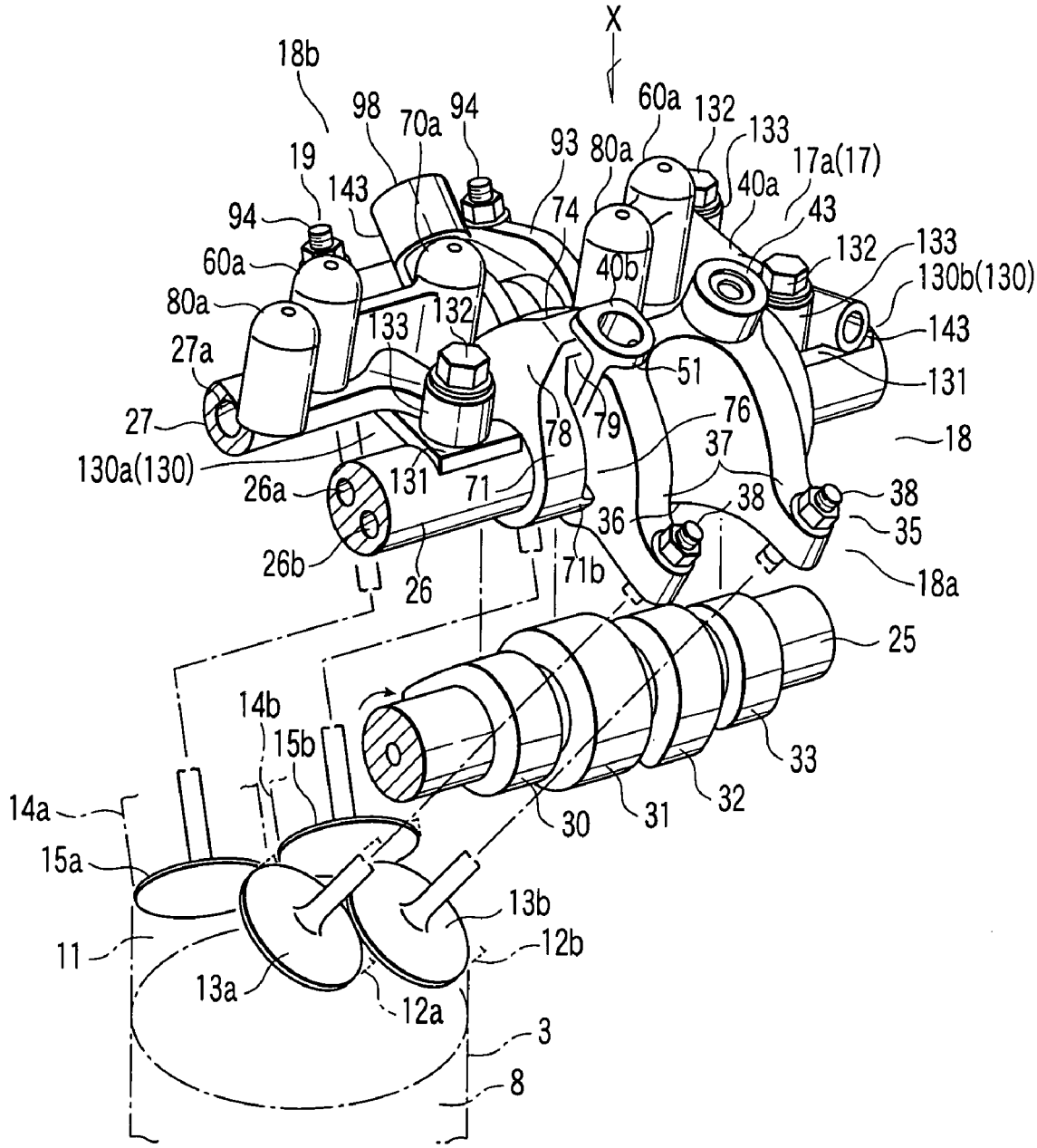
FIG. 4 is a perspective view showing a variable valve device for one cylinder which is mounted on the left bank.
Figure 5:
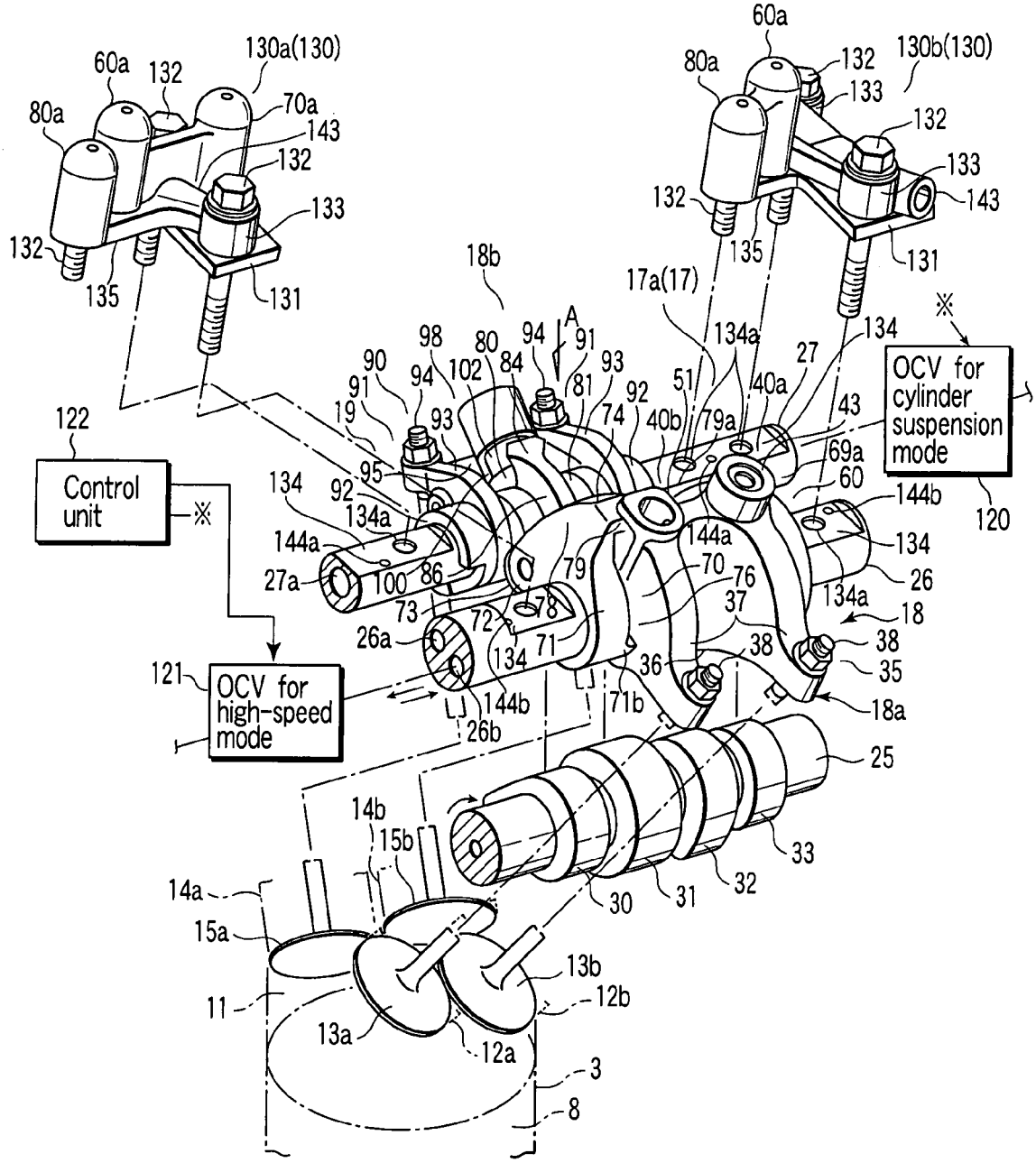
FIG. 5 is a perspective view showing a state in which a rocker shaft cap is disconnected from the variable valve device.

FIG. 2 is a plan view showing a left bank of the V-type engine, FIG. 3 is a plan view showing a state in which a part of a rocker shaft and a rocker shaft cap are left in the left bank, FIG. 4 is a perspective view showing a variable valve device of inlet and exhaust valves of the V-type engine, and FIG. 5 is a perspective view showing a state in which the rocker shaft cap is disconnected from the variable valve device.

Figure 6:
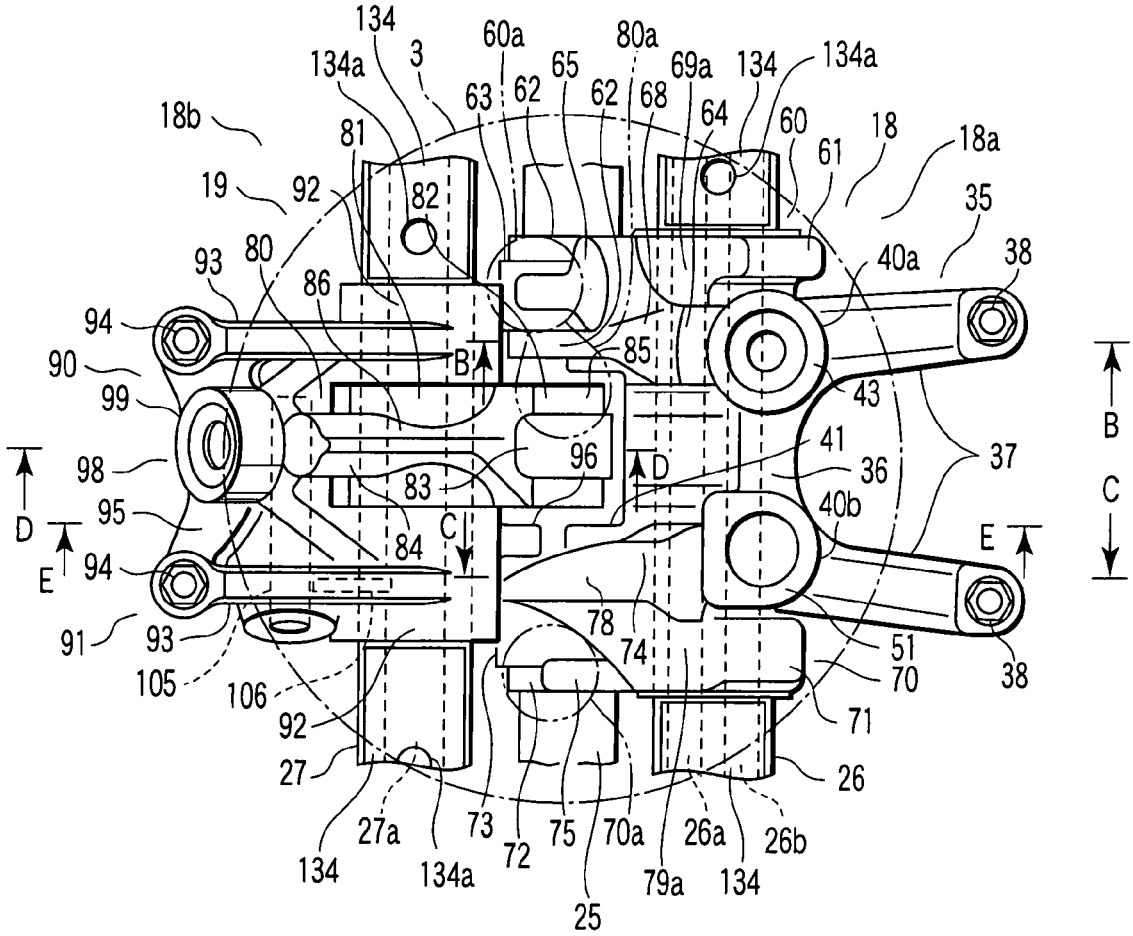
FIG. 6 is a plan view showing the variable valve device when viewed from an arrow A of FIG. 5.
Figure 7:
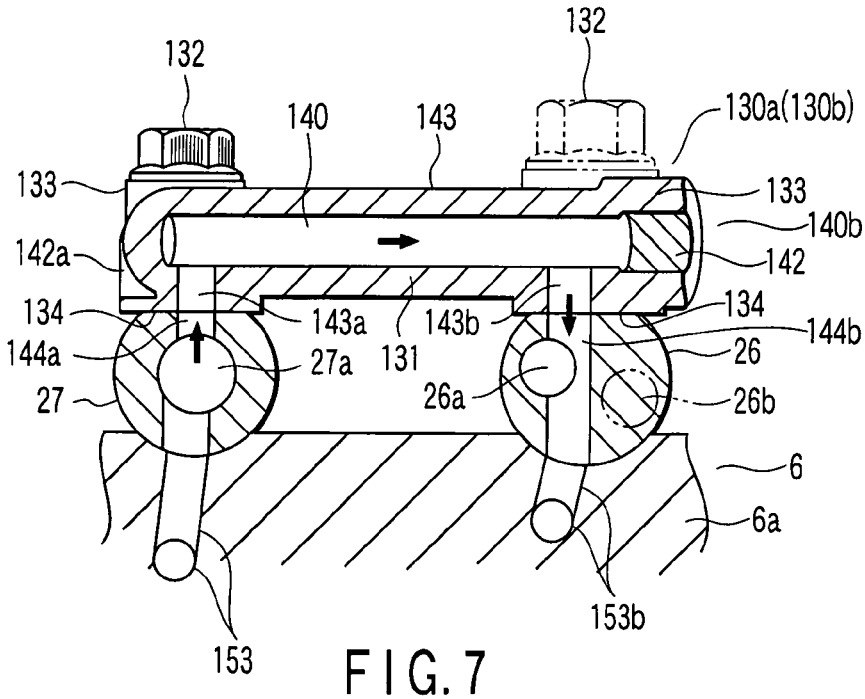
FIG. 7 is a sectional view showing the rocker shaft cap taken on line F-F of FIG. 3.
Figure 8:
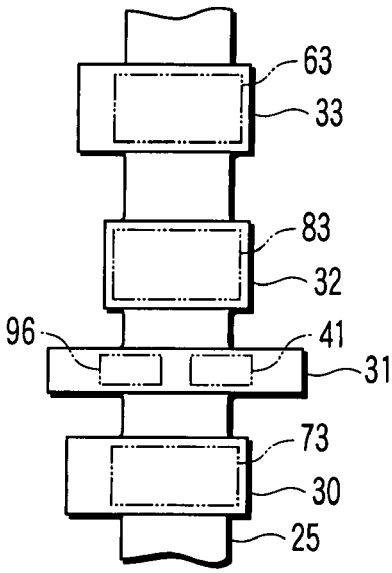
FIG. 8 is a plan view showing a layout of various cams of a camshaft.
Figure 15:
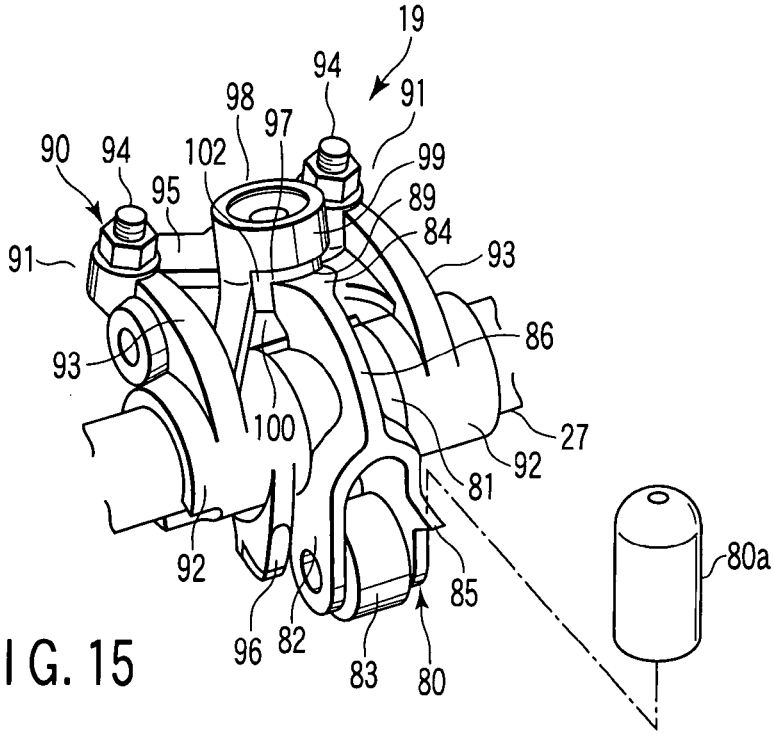
FIG. 15 is a perspective view showing an exhaust-side arm rocker structure.
Figure 16:
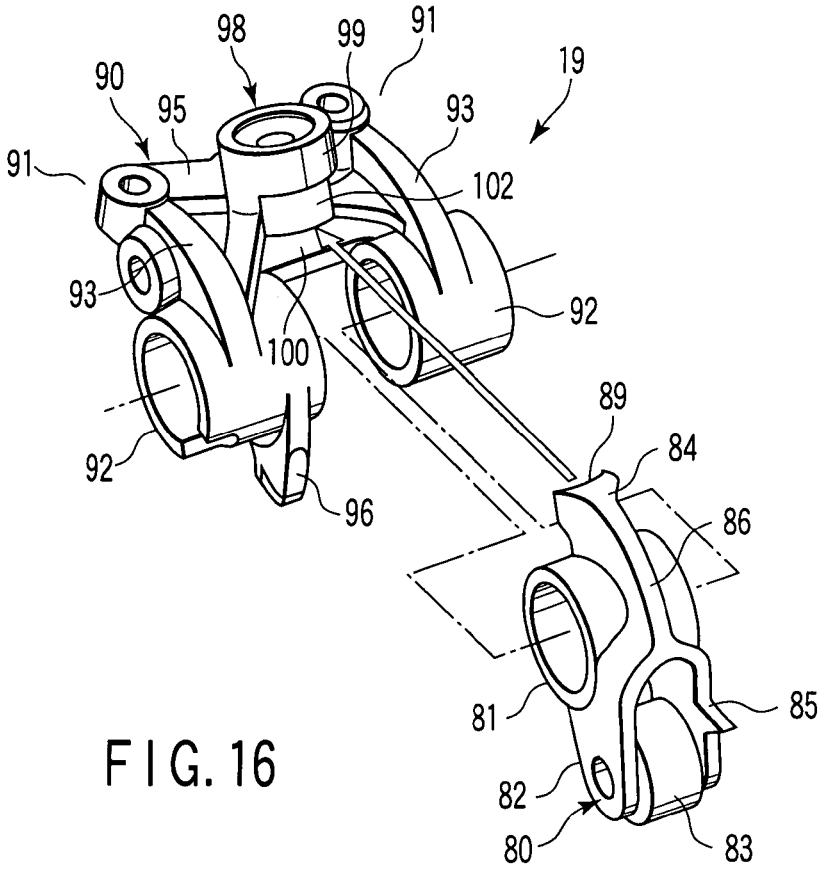
FIG. 16 is a perspective view showing a state in which the exhaust-side arm rocker structure is taken apart.
Figure 17:
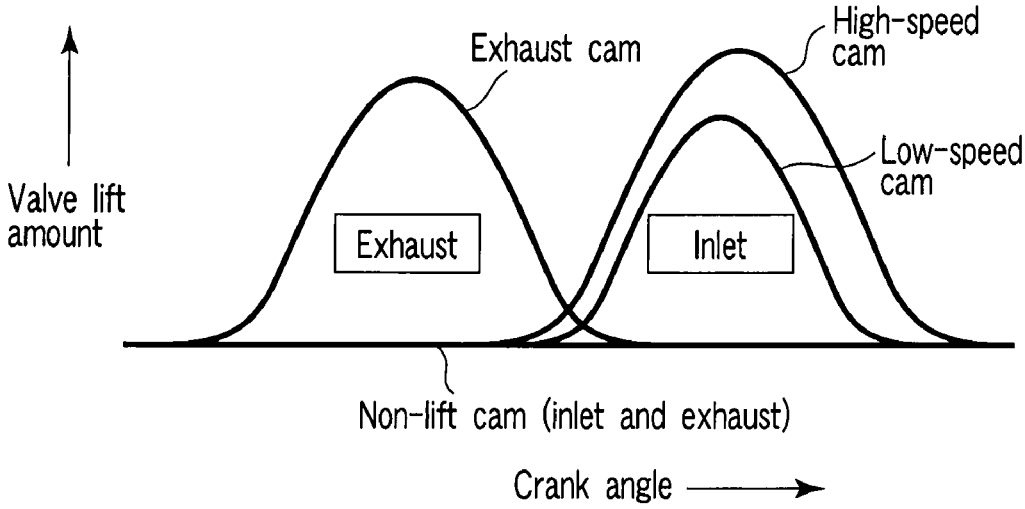
FIG. 17 is a view explaining an operating mode of the variable valve device.

FIG. 6 is a plan view showing the variable valve device when viewed from an arrow A of FIG. 5, FIG. 7 is a sectional view showing the rocker shaft cap taken on line F-F of FIG. 3, and FIG. 8 is a plan view showing various cams of the variable valve device. FIGS. 9 to 12 are sectional views showing portions of the variable valve device when viewed from arrows B to E of FIG. 6, respectively. FIG. 13 is a perspective view showing an inlet-side arm rocker structure, FIG. 14 is an exploded perspective view showing the inlet-side arm rocker structure, FIG. 15 is a perspective view showing an exhaust-side arm rocker structure, FIG. 16 is an exploded perspective view showing the exhaust-side arm rocker structure, and FIG. 17 is a view explaining valve characteristics brought by the variable valve device. In FIG. 1, the letter Fr designates a forward direction of the V-type engine.

Referring to FIG. 1, reference numeral 1 designates an engine body of the V-type engine. The engine body 1 includes a V-shaped cylinder block 5 and cylinder heads 6. Specifically, the cylinder block 5 includes a common crankcase portion 2 in a lower portion thereof, and the cylinder block 5 includes V-shaped deck cylinder portions 4 in an upper portion thereof. Each of the V-shaped deck cylinder portions 4 has three cylinders 3 (shown in FIGS. 4 to 6). The cylinder heads 6 are mounted on head portions of the deck cylinder portions 4 respectively.

Small components such as a head cover and an oil pan are not shown in FIG. 1. Each of right and left banks 7*a* and 7*b* projected in the V-shaped is formed by the deck cylinder portion 4 and the cylinder head 6. The right and left of the banks are defined based on the forward direction. As shown in FIGS. 4 and 5, a piston 8 is accommodated in the cylinder 3 in each of the banks 7*a* and 7*b* while being able to be reciprocated. A crankshaft (not shown) is incorporated into the crankcase portion 2.

However, the banks 7*a* and 7*b* are offset in a back and forth direction such that connecting rods (not shown) extended from the pistons 8 are arranged while aligned with an axial line of the crankshaft.

As shown in FIGS. 4 and 5, in the lower surface of the cylinder head 6, a combustion chamber 11 is formed in a region facing the cylinder 3. In each combustion chamber 11, two (plural) inlet ports 12*a* and 12*b* and two (plural) inlet valves 13*a* and 13*b* are provided in the inside of the banks 7*a* and 7*b* as shown in FIGS. 4 and 5. The inlet valves 13*a* and 13*b* open and close the inlet ports 12*a* and 12*b* respectively. Two (plural) exhaust ports 14*a* and 14*b* and two (plural) exhaust valves 15*a* and 15*b* are provided in the outside of the banks 7*a* and 7*b*. The exhaust valves 15*a* and 15*b* open and close the exhaust ports 14*a* and 14*b*. Therefore, the combustion air is sucked from the inside of the bank, and the burned gas is exhausted from the outside of the bank in the engine 1.

A consistently-closed structure biased toward a closed direction by a valve spring (not shown) is used in the inlet valves 13*a* and 13*b* and the exhaust valves 15*a* and 15*b* respectively.

Single overhead camshaft (SOHC) variable valve systems 17 are provided in the cylinder heads 6 of the right and left banks 7*a* and 7*b*. As shown in FIG. 2, a variable valve system 17*a* of left bank 7*a* includes an (three-mode switchable) inlet rocker arm module 18 and an (two-mode switchable) exhaust rocker arm module 19. A normal (low-speed) mode, a high-speed mode (corresponding to a second mode of the invention), and a cylinder suspension mode (mode for suspending the cylinder: corresponding to a first mode of the invention) can be switched in the inlet rocker arm module 18. The normal (low-speed) mode and the cylinder suspension mode (mode for suspending the cylinder: corresponding to a first mode of the invention) can be switched in the exhaust rocker arm module 19. The variable valve system 17*a* is defined as variable valve device in the present invention.

The variable valve system 17*b* of the right bank 7*b* includes an (two-mode switchable) inlet rocker arm module 20 and a variable valve device 21. The normal (low-speed) mode and high-speed mode can be switched in the inlet rocker arm module 20. The variable valve device 21 has only the normal (low-speed) mode.

FIGS. 4 to 6 show a structure of the one cylinder of the variable valve system 17*a*, which is mounted on the left bank 7*a*, when viewed from behind the engine. FIG. 13 shows the rocker arm module 18 when viewed from the inside. FIG. 14 shows a state in which the rocker arm module 18 is taken apart. FIG. 15 shows the rocker arm module 19 when viewed from the inside. FIG. 16 shows a state in which the rocker arm module 19 is taken apart.

The structure of the one cylinder will be described below. Referring to FIGS. 4 to 6, a rotatable camshaft 25 is arranged along a longitudinal direction of the cylinder head 6 in the center of an overhead location of the combustion chamber 11. An inlet rocker shaft 26 (corresponding to one of rocker shafts of the invention) is fixed to the inside of the bank while arranged substantially parallel to the camshaft 25. An exhaust-side rocker shaft 27 (corresponding to the other rocker shaft of the invention) is fixed to the outside of the bank while arranged substantially parallel to the camshaft 25.

The rocker shafts 26 and 27 are arranged in pairs above the camshaft 25. An oil passage 27*a* for the cylinder suspension mode (corresponding to a second switching oil passage of the invention) is formed along an axial direction in the rocker shaft 27. An oil passage 26*a* for the cylinder suspension mode (corresponding to a first switching oil passage of the invention) is formed along an axial direction in the rocker shaft 26, and an oil passage 26*b* for high-speed mode (corresponding to a third switching oil passage of the invention) is also formed along the axial direction in the rocker shaft 26. That is, unlike the rocker shaft 27, the oil passage 26*a* and the oil passage 26*b* are arranged parallel in the rocker shaft 26.

As shown in FIG. 7, the rocker shafts 26 and 27 are arranged in the upper surfaces of ribs 6*a*. The cylinder 3 is located between the ribs 6*a*, which are raised from the upper surface portion of the cylinder head 6. Portions of the rocker shafts 26 and 27 are provided between the ribs 6*a* of the cylinder head 6 with the rocker shaft caps.

Specifically, as shown in FIGS. 2 to 5, a rocker shaft cap 130 includes a rocker shaft cap 130*a* and a rocker shaft cap 130*b*. The rocker shaft cap 130*a* is arranged between the cylinders 3 and the rocker shaft cap 130*b* is arranged at the end of the line of cylinders 3.

As shown in FIGS. 4, 5, and 7, both the rocker shaft caps 130*a* and 130*b* have the structures in which plural cylindrical bolt insertion portions 133 into which bolts 132 are inserted are formed in a plate-shaped base portion 131 spreading across the rocker shafts 26 and 27.

Therefore, as shown in FIGS. 5 and 7, the base portion 131 is fitted in recesses 134 formed in the upper portions (side opposite the rib 6*a*) of the rocker shafts 26 and 27, and bolts 132 are screwed into the ribs 6*a* from bolt insertion portions 133 of the base portion 131 through holes 134*a* (shown in FIGS. 5 and 6) made in the rocker shafts 26 and 27. In this manner, the rocker shaft caps 130*a* and 130*b* are fixed to the cylinder head 6 along with the rocker shafts 26 and 27.

In the fixing structure of the rocker shaft caps 130*a* and 130*b*, a single bolt 132 is used on the side of the rocker shaft 26, and two bolts 132 are used on the side of the rocker shaft 27.

As shown in FIG. 3, except for the rocker shaft cap 130*b* located at the end of the engine (since the oil passage 26*a* is not provided in this portion), oil passages 140 (corresponding to a relay oil passage of the invention) are formed in the rocker shaft caps 130*a* and 130*b*.

As shown in FIG. 7, each of the oil passages 140 is formed from a cylindrical portion 143 which is formed along the rocker shafts 26 and 27 on the base portion 131. The cylindrical portion 143 has a bottom 142*a* on one end side thereof, and has an opening 142*b* closed by a plug 142 on the other side.

Specifically, the bottom side of the cylindrical portion 143 is arranged between the two bolt insertion portions 133 and 133 on the side of the rocker shaft 27. The opening is arranged at a point adjacent to the bolt insertion portion 133 on the side of the rocker shaft 26. Therefore, the cylindrical portion 143 is obliquely arranged. A thin passage in the cylindrical portion 143 is used as the oil passage 140.

As shown in FIG. 7, through holes 143*a* and 143*b* communicating with the ends of the oil passage 140 are made in a backside portion of the base portion 131 which is one end portion of the cylindrical portion 143 and a backside portion of the base portion 131 which is the other end portion respectively.

As shown in FIG. 7, the through hole 143*a* on the side of the exhaust-side rocker shaft 27 communicates with a branch hole 144*a* (also shown in FIG. 5) branching off the oil passage 27*a* of the rocker shaft 27. The through hole 143*b* on the side of the inlet-side rocker shaft 26 communicates with a branch hole 144*b* (also shown in FIG. 5) branching off the oil passage 26*a* of the rocker shaft 26.

The plural (for example, three) oil passage structures are formed whereby the whole of the oil passage 26*a* communicates with the whole of the oil passage 27*a*, which are parallel to each other, via the plurality of oil passages 140. A ladder-shaped oil passage 146 is formed from the oil passage structures.

The camshaft 25 is rotated by a crank output. In a shaft portion (between rocker shaft caps 130) in which the camshaft 25 is arranged in the overhead location of the combustion chamber 11 of the camshaft 25, as shown in FIGS. 4, 5, and 8, a high-speed inlet cam 30, a non-lift cam 31, an exhaust cam 32, and a low-speed inlet cam 33 are formed in this order from the rear side of the engine.

The low-speed inlet cam 33 has a cam profile in which open-close timing and a valve lift amount are set so as to be suitable to low-speed running of the engine. The high-speed inlet cam 30 has a cam profile in which open-close timing and a valve lift amount (larger than that of the low-speed cam 33) are set so as to be suitable to high-speed running of the engine. The non-lift cam 31 has a cam profile formed only by the base circle having the same radius larger than the base circles of the inlet cams 30 and 33 and the exhaust cam 32. The exhaust cam 32 obviously has a cam profile in which the open-close timing and the valve lift amount are set so as to be suitable to the discharge of the combustion gas.

The inlet rocker arm module 18 has the structure in which the hydraulic type rocker arm 18*a* is installed in the rocker shaft 26 as shown in FIGS. 4 to 6, 13, and 14. The rocker arm module 18 includes a valve drive rocker 35, and a pair of low-speed and high-speed cam follower rockers 60 and 70. The valve drive rocker 35 drives the inlet valves 13*a* and 13*b*, and the cam follower rockers 60 and 70 follow the inlet cams 30 and 33 respectively.

As shown in FIGS. 4, 5, and 14, the valve drive rocker 35 includes a cylindrical rocker shaft supporting boss 36, a pair of rocker arms 37, adjustment screws (abutment) 38, and mode switching operation portions 40*a* and 40*b*. The rocker arms 37 are extended from both end portions of the boss 36 toward the inlet valves 13*a* and 13*b* (radial direction of the boss). The adjustment screws 38 are attached to the front-end portions of the rocker arms 37. The mode switching operation portions 40*a* and 40*b* are provided in base portions of the rocker arms 37.

As shown in FIGS. 4 to 6, the rocker shaft 26 is rotatably fitted in the boss 36 of the rocker arm 37 in the range of a point where the inlet cam 30 (for high speed) exists to a point where the inlet cam 33 (for low speed) exists. In the boss 36, the adjustment screws 38 in the front-end portions of the rocker arms 37 are positioned at the upper ends (valve stem ends) of the inlet valves 13*a* and 13*b*.

That is, when the valve drive rocker 35 is rocked about the rocker shaft 26, the end portions of the adjustment screws 38 abut the valve stem ends to drive the inlet valves 13*a* and 13*b*.

Figure 12:
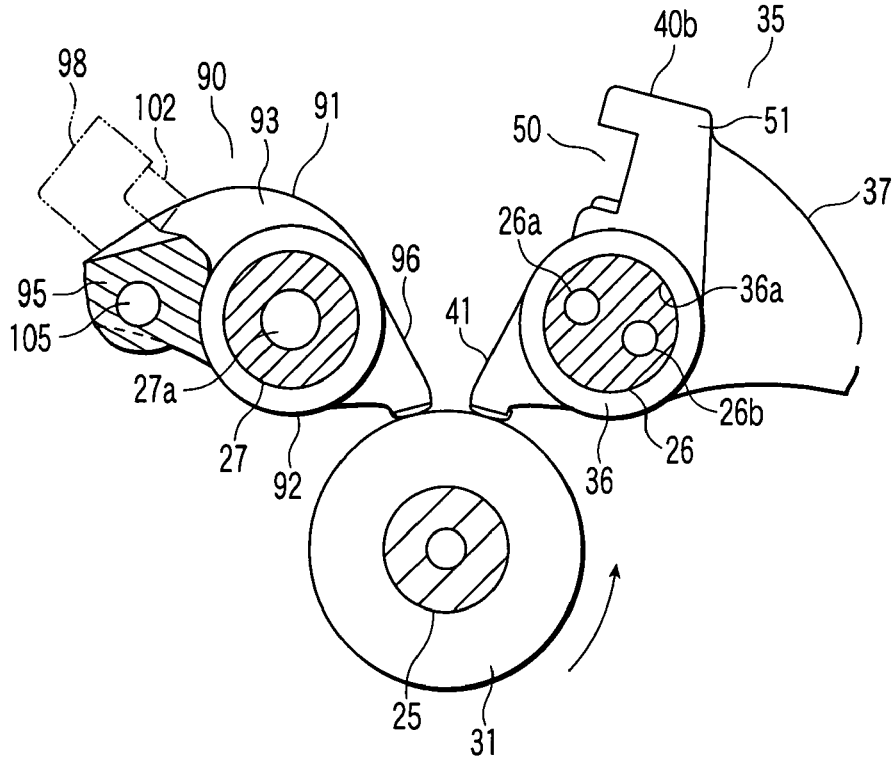
FIG. 12 is sectional view showing a non-lift cam shown in FIG. 6, taken along line E-E shown in FIG. 6.
Figure 13:
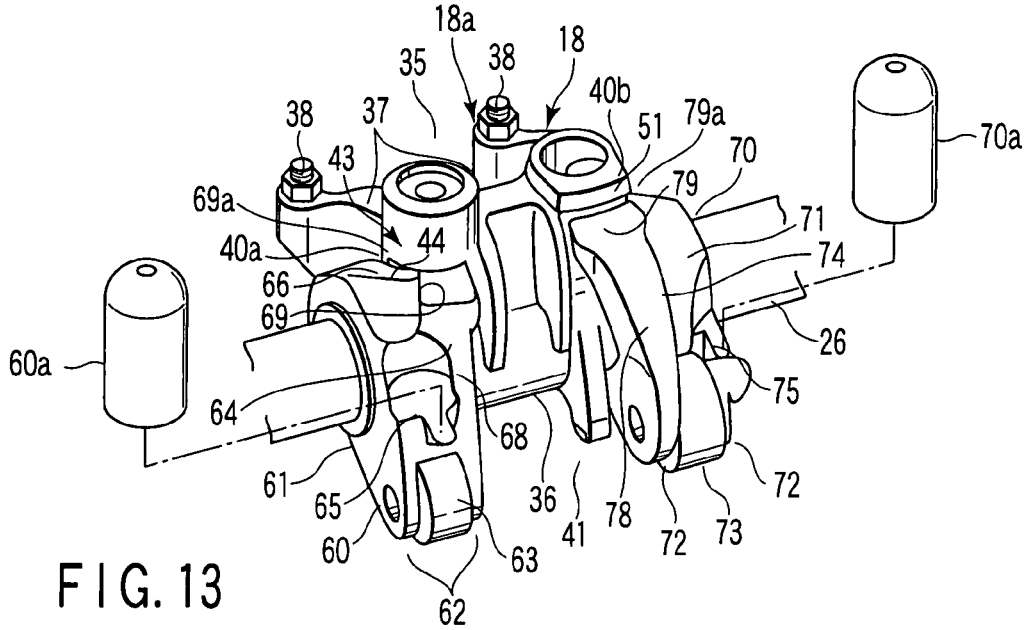
FIG. 13 is a perspective view showing an inlet-side arm rocker structure.
Figure 14:
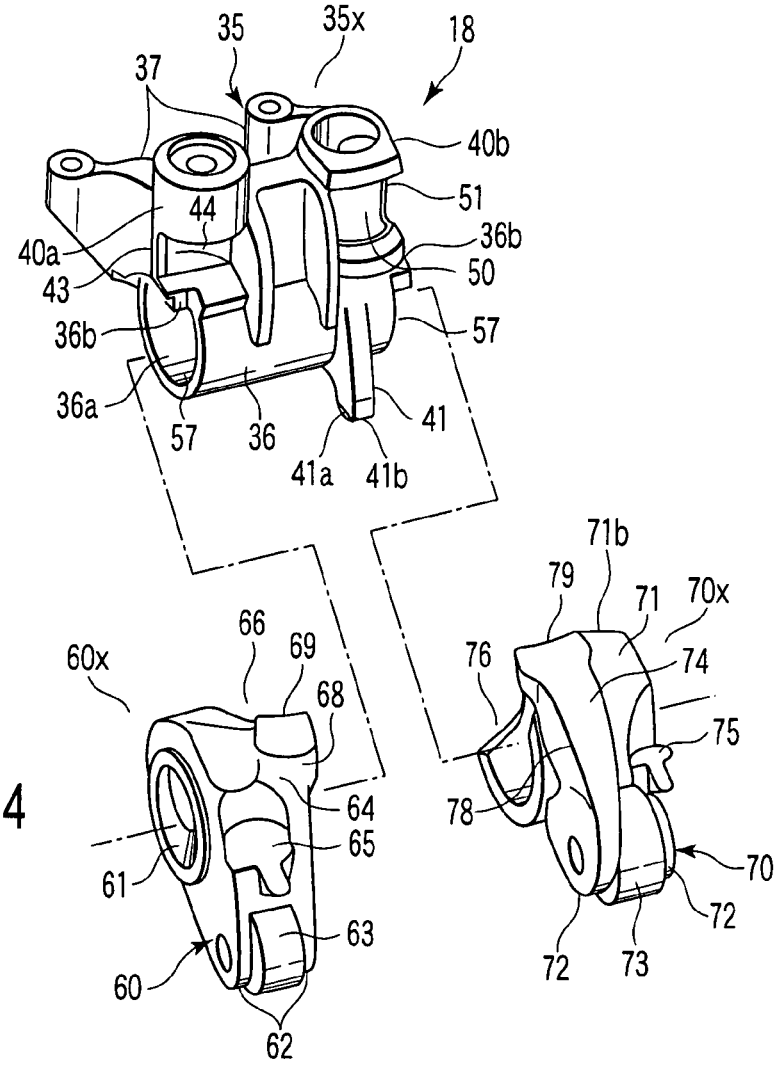
FIG. 14 is a perspective view showing a state in which the inlet-side arm rocker structure is taken apart.

In the outer peripheral surface of the boss 36, a slipper 41 is projected toward the outer peripheral surface of the non-lift cam 31 from the region where the boss 36 faces the non-lift cam 31 as shown in FIGS. 12 to 14.

A projected length of the slipper 41 is set to a size, in which the front-end portion of the slipper 41 can abut the outer peripheral surface of the non-lift cam 31 when the inlet valves 13*a* and 13*b* are closed. When the inlet valves 13*a* and 13*b* are closed, the slipper 41 is caused to abut the non-lift cam 31 by reaction forces of the valve springs of the inlet valves 13*a* and 13*b*, which prevents accidental motion of the whole of the valve drive rocker 35.

Figure 9:
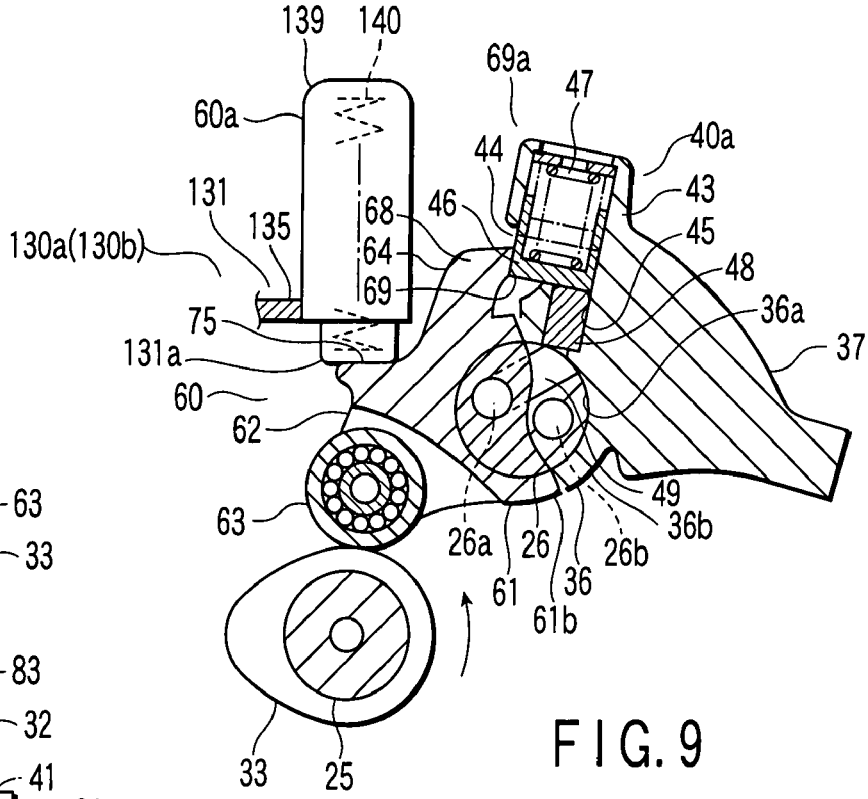
FIG. 9 is a sectional view showing an inlet-side (low-speed) rocker arm shown in FIG. 6, taken along line B-B shown in FIG. 6.

A piston type switching operation portion is used as both the switching operation portions 40*a* and 40*b* arranged in both end portions of the boss 36. The switching operation portion 40*a* arranged on the side of the inlet cam 33 (for low speed) will be described below. Referring to FIGS. 9, 13, and 14, a cylinder 43 is formed in a based portion of the rocker arm 37 on the side of the inlet cam 33. The cylinder 43 is a longitudinal one which is extended along a radial direction of the rocker shaft 26. A window 44 is formed in a front surface (surface on the side of the camshaft 25) in the lower portion of the cylinder 43. A through hole 45 (shown only in FIG. 9) having a diameter smaller than that of the cylinder 43 is made from the bottom of the cylinder 43 to an inner surface 36*a* (bearing surface) of the boss 36 located immediately below the cylinder 43.

A piston 46 which becomes a reception portion is accommodated in the cylinder 43 along with a compression spring 47 which biases the piston 46 against the bottom of the cylinder 43 (shown only in FIG. 9). Therefore, usually the window 44 of the cylinder 43 is closed by the lower outer peripheral surface of the piston 46, and the piston 46 is retracted from the window 44 to open the window 44 when the piston 46 is raised.

As shown in FIG. 9, a pin 48 is slidably accommodated in the through hole 45, and an opening located at a lower end of the through hole 45 communicates with a branch passage 49 branching off the oil passage 26*a*. Therefore, when oil pressure is applied to the pin 48 through the oil passage 26*a*, the piston 46 is driven in the direction in which the piston 46 is retracted from the window 44 by the raised motion of the pin 48 as shown by an alternate long and two dashes line of FIG. 9. That is, the window 44 is opened.

Figure 10:
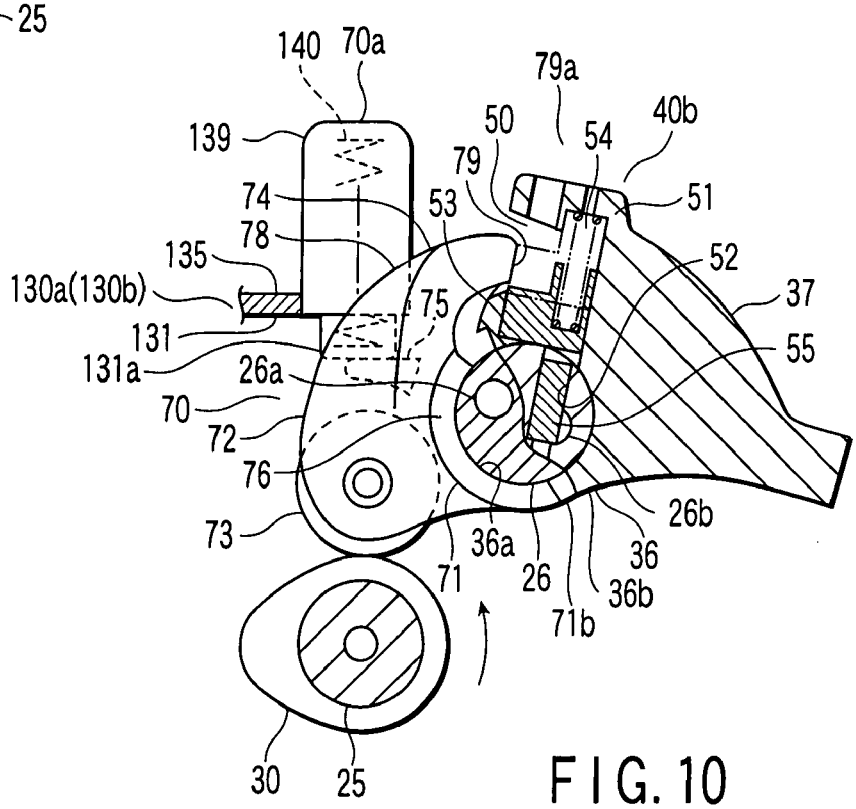
FIG. 10 is a sectional view showing an inlet-side (high-speed) rocker arm shown in FIG. 6, taken along line C-C shown in FIG. 6.

As with the switching operation portion 40*a*, a structure in which a cylinder 51 is formed in the base portion of the rocker arm 37 is used in the switching operation portion 40*b* arranged on the side of the inlet cam 30 (for high speed) as shown in FIGS. 10, 13, and 14. The cylinder 51 is extended to the inner surface 36*a* of the boss 36 to gain a stroke amount. Therefore, a through hole 52 communicating with the cylinder 51 in series is made in the rocker shaft 26 located immediately below the cylinder 51.

The through hole 52 has the diameter smaller than that of the cylinder 51. Unlike the switching operation portion 40*a*, as shown in FIG. 10, a window 50 is formed in the upper front surface of the cylinder 51, and a piston 53 is accommodated in the cylinder 51 along with a compression spring 54 which biases the piston 53 against the bottom of the cylinder 51.

A low-profile piston is used as the piston 53 such that the piston 53 can be accommodated in the cylinder portion on the lower side from the window 50. Contrary to the switching operation portion 40*a*, usually the opening of the window 50 of the cylinder 51 is opened, and the opening is closed by the outer peripheral surface of the piston 53 when the piston 53 is raised. As shown in FIG. 10, a pin 55 is slidably accommodated in the through hole 52, and the lower-end portion of the through hole 52 communicates with a part of the oil passage 26*b* while intersecting the oil passage 26*b*. When the oil pressure is applied to the pin 55 through the oil passage 26*b*, the piston 53 is driven in the direction in which the piston 53 blocks the window 50 by the raised motion of the pin 55 as shown by the alternate long and two dashes line of FIG. 10. That is, the window 50 is closed.

As shown in FIG. 14, cut portions 57 are formed in opening edges on both the end portions of the boss 36. The cut portion 57 is formed by continuously cutting out the region ranging from the portions immediately below the cylinders 43 and 51 to the base portion of the rocker arm 37 through the front portion of the boss 36 (on the side opposite the rocker arm 37) in the peripheral wall forming the boss end.

As shown in FIGS. 2, 4 to 6, 10, 13, and 14, a high-speed-side cam follower rocker 70 is arranged adjacent to the end portion on the side of the inlet cam 30 (for high speed) of the boss 36 (valve drive rocker).

The cam follower rocker 70 includes a cylindrical rocker shaft supporting boss 71, a pair of roller support pieces (roller yoke) 72, a roller (rotating contact) 73, and an abutment 79. The rocker shaft 26 is rotatably fitted in the boss 71. The roller support pieces 72 are linearly projected toward the overhead location of the inlet cam 30 (for high speed) from both the end portions of the boss 71. The roller 73 is rotatably supported between the front-end portions of the roller support pieces 72. The abutment 79 is formed in a peripheral wall of the boss 71.

Therefore, the cam follower rocker 70 has the structure in which the cam follower rocker 70 has the roller 73 on one end side while having the abutment 79 on the other end side. The roller 73 is rotated while being in contact with the cam surface of the inlet cam 30. When the camshaft 25 is rotated, the cam follower rocker 70 is rocked around the boss 71 while following the displacement of the inlet cam 30.

As shown in FIG. 14, a cut portion 76 is formed in the end portion of the boss 71 adjacent to the boss 36 (valve drive rocker), and the cut portion 76 is formed by cutting out the peripheral wall portion from the boss end to a predetermined extent. The cut portion 76 is formed by continuously cutting out the circumferential portion ranging from the upper side of the boss 71 to the front portion of the boss 71 (on the side opposite the rocker 73).

The cut portion 76 at the end of the boss 71 and the cut portion 57 at the end of the boss 36 are fitted in an edge portion 36*b* remaining at the opening end of the boss 36 and an edge portion 71*b* remaining at the opening end of the boss 71 in a complementary manner respectively.

The fitting between the above portions obviously permits required motion of the cam follower rocker 70. The fitting wraps the edge portion 36*b* at the end of the boss 36 and the edge portion 71*b* at the end of the boss 71 around the axial direction of the rocker shaft 26 in the outer peripheral surface of the rocker shaft 26.

The abutment 79 is arranged in the edge portion 71*b*. The window 50, the cylinder 51, the piston 53, and the compression spring 54 are arranged in the edge portion 36*b*. The abutment 79 and the piston 53 are positioned so as to face each other when the edge portion 36*b* and the edge portion 71*b* are wrapped. Therefore, as shown in FIGS. 13 and 14, the abutment 79 of the boss 71 and the window 50 located in the boss 36 face each other by utilizing the side-by-side arrangement of the rocker shafts 26 of the edge portions 71*b* and 36*b* in the circumferential direction.

The roller support piece 72 arranged close to the boss 36 (inside) is arranged substantially straight in front of the abutment 79. The roller support piece 72 on the other side and the abutment 79 are arranged in line with respect to the window 50.

As shown in FIGS. 13 and 14, in the outer peripheral surface of the boss 71, a wing portion 74 is provided in the range from the abutment 79 to the inside roller support piece 72 (close to the boss 36). The wing portion 74 is formed by a rib 78 which continuously and linearly connects the abutment 79 and roller support piece 72.

The abutment 79 is formed in the shape in which a horizontal wall of the front-end portion of the rib 78 can enter and leave from the window 50. Usually the abutment 79 enters and leaves from the cylinder 51 through the window 50. When the window 50 is blocked by the piston 53, the abutment 79 abuts the piston 53 exposed from the window 50.

That is, the switching whether or not the displacement of the high-speed inlet cam 30 from the cam follower rocker 70 is transmitted to the valve drive rocker 35 is performed based on whether the abutment 79 strikes at the air or abuts on the piston 53. The abutment 79 and the switching operation portion 40*a* constitute a switching mechanism 79. The switching mechanism 79*a* is defined as inlet switching unit in the present invention.

As shown in FIG. 10, a seat 75 is formed on the front-end side of the outside roller supporting piece 72 so as to receive the biasing force (force pressing the roller 73 against the inlet cam 30) from a pusher 70*a* incorporated into a rocker shaft cap 130.

As shown in FIGS. 2, 4 to 6, 9, 13, and 14, the lower-speed-side cam follower rocker 60 is arranged adjacent to the end portion on the side of the inlet cam 33 (for low speed) of the boss 36. The cam follower rocker 60 has a symmetric structure with the high-speed-side cam follower rocker 70.

Because the cam follower rocker 60 has the same structure as the cam follower rocker 70, the same portions of the cam follower rocker 60 are designated by reference numerals 61 to 69 in place of reference numerals 71 to 79 designating the portions of the cam follower rocker 70, and the description thereof is omitted.

Obviously the abutment 69 is formed in the shape in which the abutment 69 can enter and leave from the window 44. As shown in FIG. 9, for the cam follower rocker 60, usually the abutment 69 abuts the piston 46 blocking the window 44. When the window 44 is opened by the piston 46, the abutment 69 enters and leaves from the cylinder 43 through the window 44.

That is, the switching whether or not the displacement of the low-speed in let cam 33 from the cam follower rocker 60 is inputted to the valve drive rocker 35 is performed based on whether the abutment 69 switch at the air or abuts on the piston 46. The abutment 69 and the piston 46 constitute the switching mechanism 69*a*. The switching mechanism 69*a* is defined as inlet switching unit in the present invention.

As shown in FIGS. 2, 4 to 6, 11, 15, and 16, the exhaust rocker arm module 19 includes a divided type rocker arm 18*b* which is divided into a cam follower rocker 80 and a valve drive rocker 90. The cam follower rocker 80 follows the exhaust cam 32 and the valve drive rocker 90 drives the exhaust valves 15*a* and 15*b*. The cam follower rocker 80 is defined as exhaust valve follower rocker in the present invention. The valve drive rocker 90 is defined as exhaust valve drive rocker in the present invention.

The cam follower rocker 80 includes a cylindrical rocker shaft supporting boss 81, a U-shaped roller support piece 82, a roller 83, and a wing portion 84. The rocker shaft 27 corresponding to the exhaust cam 32 is rotatably fitted in the boss 81. The U-shaped roller support pieces 82 are linearly projected from both the end portions of the boss 81 toward the overhead location of the exhaust cam 32. The roller 83 is rotatably supported between the front-end portions of the roller support piece 82. The wing portion 84 is formed in the boss 81.

The roller 83 is rotated while being in contact with the cam surface of the exhaust cam 32. When the camshaft 25 is rotated, the cam follower rocker 80 is rotated about the boss 81, namely, the cam follower rocker 80 is rocked while following the displacement of the exhaust cam 32. A seat 85 is formed on the front-end side of the cam follower rocker 80 so as to receive the biasing force (force pressing the roller 83 against the exhaust cam 32) from a pusher 80*a* incorporated into the rocker shaft cap 130.

The wing portion 84 is formed by a rib 86 projected toward the center in the width direction of the outer surface of the boss 81. The rib 86 is extended along a circumferential direction of the boss 81 from the rear-end portion of the roller support piece 82 to the upper portion of the boss 81. An abutment 89 overhung forward is provided in the front-end portion of the rib 86.

As shown in FIGS. 2, 4 to 6, 11, 15 and 16, the valve drive rocker 90 has the structure in which a gate-shaped rocker arms 91 and a mode switching operation portion 98 are combined. The rocker arms 91 are arranged on both sides of the boss 81 (cam follower rocker 80).

A pair of cylindrical rocker shaft supporting bosses 92 is provided in each one end portion of the rocker arm 91. The rocker shaft 27 is rotatably fitted in the bosses 92 on both sides where the boss 81 (cam follower rocker 80) is located between the bosses 92. Arms 93 are provided in the other end portion of the rocker arms 91, and the arms 93 are linearly extended from the bosses 92 to the exhaust valves 15*a* and 15*b* respectively.

Adjustment screws 94 are provided in the front-end portions of the arms 93 respectively. The adjustment screws 94 are arranged at the upper ends (valve stem ends) of the exhaust valves 15*a* and 15*b* respectively. The front-end portions of the arms 93 and 93 are connected by a plate-shaped connecting arm 95. Therefore the valve drive rocker 90 has the gate shape.

When the valve drive rocker 90 is rocked about the rocker shaft 27, the plural exhaust valves 15*a* and 15*b* are driven.

As shown in FIGS. 12, 15, and 16, a slipper 96 is provided so as to be projected toward the outer peripheral surface of the non-lift cam 31 from the outer peripheral surface of the boss 92 which is arranged in the overhead location of the non-lift cam 31. The projected length of the slipper 96 is set to a size in which the front-end portion of the slipper 96 can abut the outer peripheral surface of the non-lift cam 31 when the exhaust valves 15*a* and 15*b* are closed.

When the exhaust valves 15*a* and 15*b* are closed, the slipper 96 is caused to abut the non-lift cam 31 by the reaction forces of the valve springs of the exhaust valves 15*a* and 15*b*, which prevents the accidental motion of the whole of the rocker arm 91.

Figure 11:
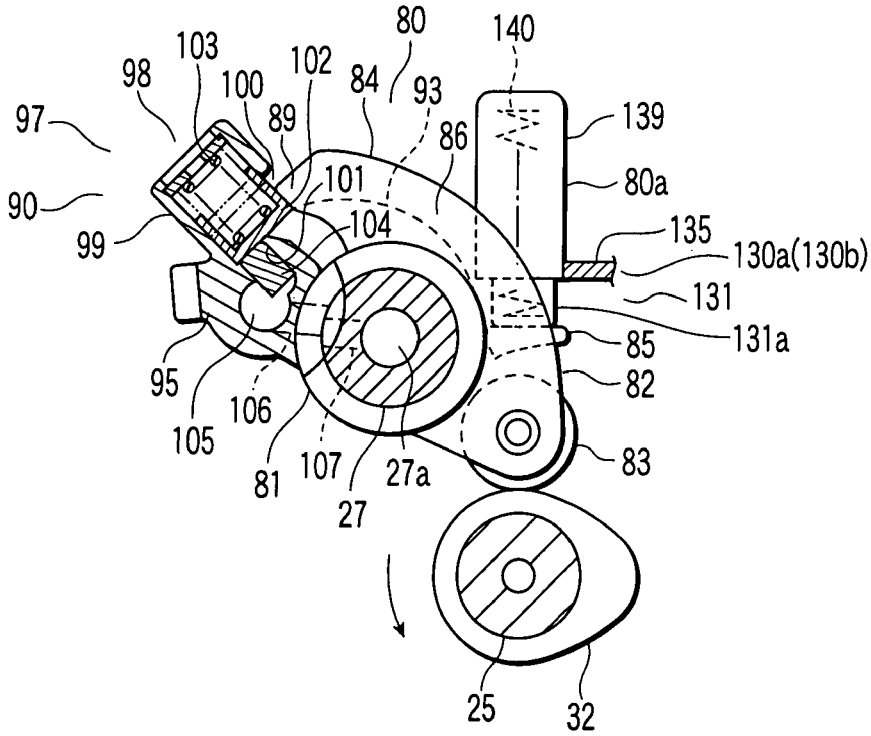
FIG. 11 is sectional view showing an exhaust-side rocker arm shown in FIG. 6, taken along line D-D shown in FIG. 6.

As shown in FIGS. 11, 15 and 16, the switching operation portion 98 is provided in the connecting arm 95. A piston type switching operation portion is used as the switching operation portion 98 as shown in FIG. 11.

The switching operation portion 98 will be described below. Referring to FIG. 11, a vertical cylinder 99 is formed so as to be projected upward from the center of the connecting arm 95. The cylinder 99 is inclined in the direction in which the cylinder 99 is separated away from the rocker shaft 27. A window 100 is formed in the front surface (surface on the side of the camshaft 25) in the lower portion of the cylinder 99. A through hole 101 having a diameter smaller than that of the cylinder 99 is made from the bottom of the cylinder 99 to the inside of the arm located immediately below the cylinder 99.

A piston 102 which becomes a reception portion is accommodated in the cylinder 99 along with a compression spring 103 which biases the piston 102 against the bottom of the cylinder 99. Therefore, usually the window 100 of the cylinder 99 is closed by the outer peripheral surface of the piston 102, and the piston 102 is retracted from the window 100 to open the window 100 when the piston 102 is raised.

A pin 104 is slidably accommodated in the through hole 101. As shown in FIGS. 6 and 11, an opening located at the lower end of the through hole 101 communicates with a relay passage 105 formed in the connecting arm 95. The relay passage 105 is opened to the inner surface of the boss 92 through a relay passage 106 formed in the arm 93. The relay passage 106 communicates with a branch passage 107 (only shown in FIG. 11) branching off the oil passage 27*a*. When the oil pressure is applied to the pin 104 through the oil passage 27*a*, the piston 102 is driven in the direction in which the piston 102 is retracted from the window 100 by the raised motion of the pin 104 as shown by the alternate long and two dashes line of FIG. 11. That is, the window 100 is opened.

The abutment 89 of the cam follower rocker 80 is positioned in front of the window 100. As shown in FIGS. 15 and 16, the abutment 89 is formed in the shape in which the abutment 89 can enter and leave from the window 100.

Therefore, usually the abutment 89 abuts the piston 102 blocking the window 100. When the window 100 is opened, the abutment 89 enters and leaves from the cylinder 99 through the window 100.

That is, the switching whether or not the displacement of the exhaust cam 32 from the cam follower rocker 80 is transferred to the valve drive rocker 90 is performed based on whether the abutment 89 strikes at air or abuts on the piston 102. The abutment 89 and the switching operation portion 98 constitute a switching mechanism 97. The switching mechanism 97 is defined as exhaust switching unit in the present invention. This structure is also adopted in each cylinder 3 of the left bank 7*a*.

Figure 18:
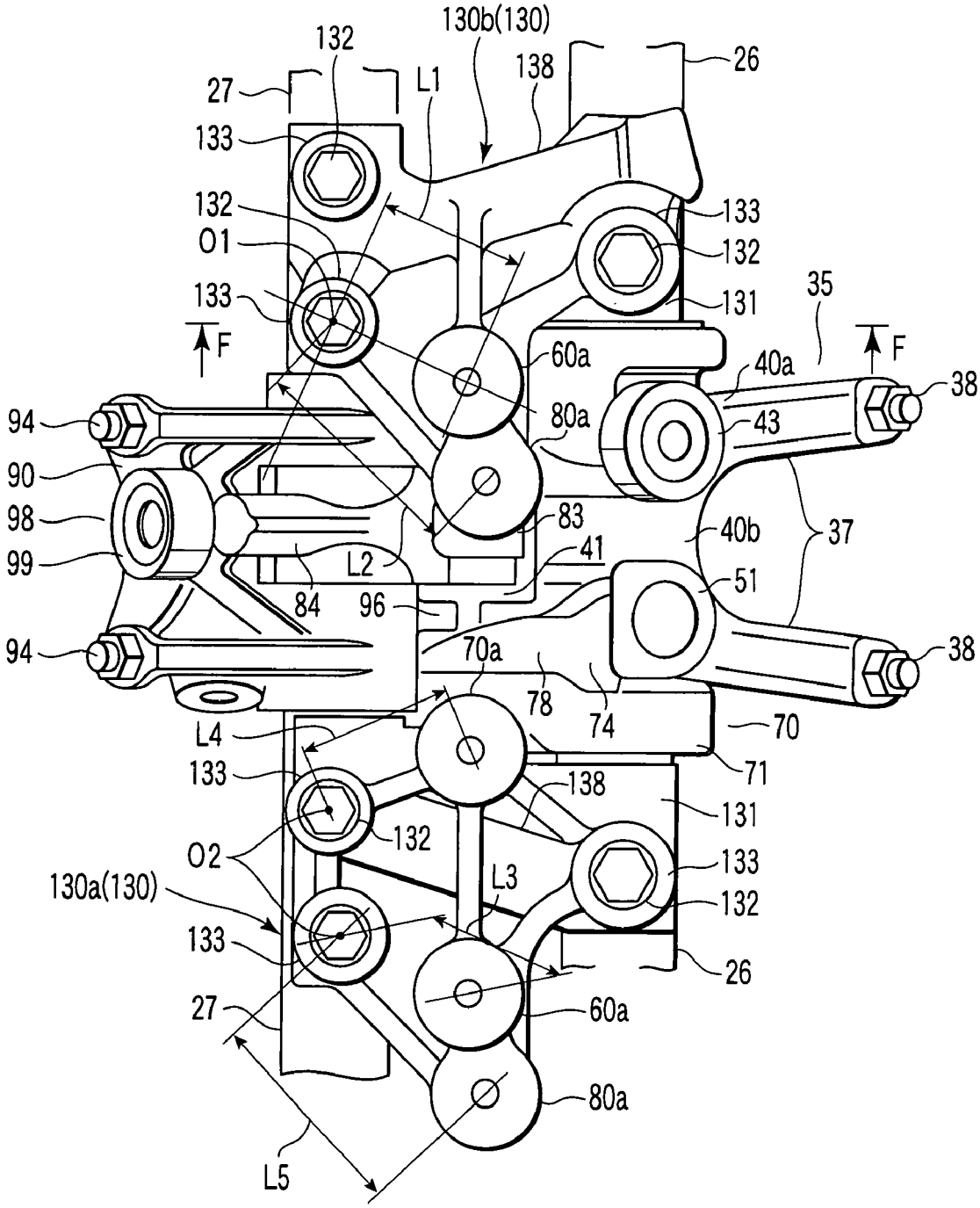
FIG. 18 is a plan view showing the variable valve device when viewed from an arrow X of FIG. 4.
Figure 19:
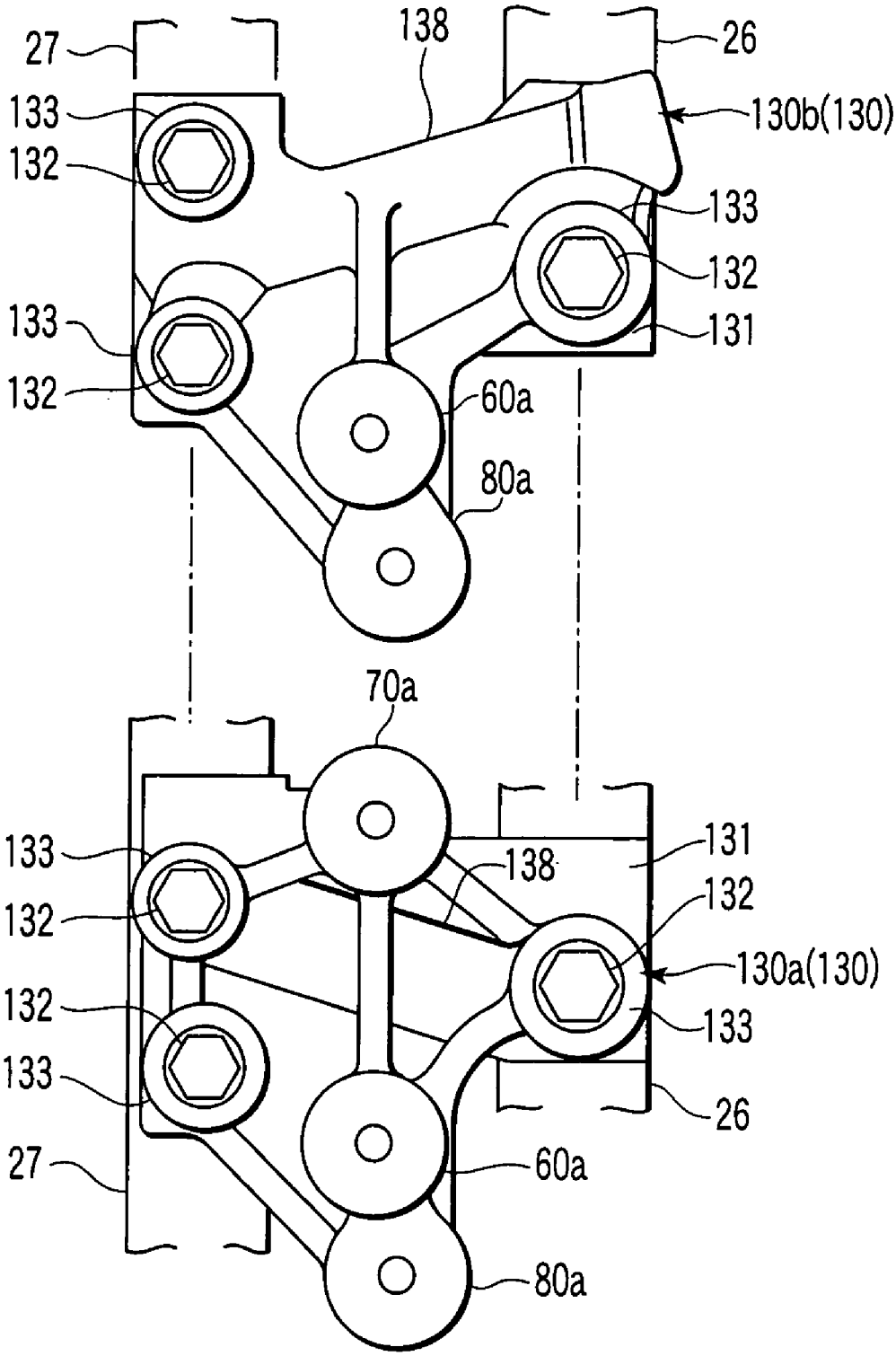
FIG. 19 is a plan view showing a state in which only the rocker shaft cap is left.

FIG. 18 is a plan view showing the variable valve system 17*a* when viewed from an arrow X of FIG. 4. As shown in FIGS. 4 and 18, in the rocker shaft cap 130 arranged at the position adjacent to the rocker arms 18*a* and 18*b*, the low-speed-side cam follower rocker 60 and plural pushers 60*a* and 80*a* are provided in the rocker shaft cap 130*b* arranged at the end of the cylinder (two kinds). The pushers 60*a* and 80*a* give the pressing force to the exhaust-side cam follower rocker 80.

Because the rocker shaft cap 130*a* arranged between the cylinders is adjacent to the high-speed-side cam follower rocker 70 of the adjacent cylinder 3, a pusher 70*a* which gives the pressing force to the cam follower rocker 70 is provided in the rocker shaft cap 130*a* in addition to the pushers 60*a* and 80*a* (three kinds).

As shown in FIGS. 9 to 11, the pushers 60*a*, 70*a*, and 80*a* have the structure in which a spring (elastic member) 140 is incorporated into a cylindrical holder 139 in which a pressing member 131*a* is attached to one end of the holder 139.

The spring force of the pusher 60*a* is set to a suitable load such that the free cam follower rocker 60 is pressed against the inlet cam 33 up to the high engine revolution speed range. The spring forces of the pushers 70*a* and 80*a* are set to a load smaller than that of the spring force of the pusher 60*a*, namely, the spring forces of the pushers 70*a* and 80*a* are set to such that the free cam follower rockers 70 and 80 are pressed against the inlet cam 33 in conjunction with the valve spring up to the high engine revolution speed range.

As shown in FIGS. 4 to 6, 9, and 11, in attaching the pushers 60*a* and 80*a* of the rocker shaft cap 130*b* (arranged at the end of the line of cylinders), attachment seats 135 are formed in a base portion 131. The attachment seats 135 are arranged immediately above the seat 65 of the low-speed-side cam follower rocker 60 and immediately above the seat 85 of the exhaust-side cam follower rocker 80 respectively. In each of the attachment seats 135, a holder 131 is placed such that the pressing member 131*a* is projected from the lower side of the rocker shaft cap 130*b*.

The projected pressing members 131*a* abut elastically on the seats 65 and 85, which applies the spring force to the cam follower rocker 60. The spring force presses the cam follower rocker 60 toward the low-speed inlet cam 33. The spring force is applied to the cam follower rocker 80 such that the cam follower rocker 80 is pressed toward the exhaust cam 32.

Therefore, in the pusher attachment structure, the low-speed cam follower rocker 60 is arranged in the outermost position, and the exhaust cam follower rocker 80 is arranged inside. As shown in FIG. 18, in the pushers 60*a* and 80*a* attached to the same rocker shaft cap 130*b*, using the pusher attachment structure and the layout of the seats 65 and 85, the pusher 60*a* is arranged close to the fixing point of the rocker shaft cap 131*b* compared with the pusher 80*a* (smaller than the pusher 60*a* in the setting load). In this case, the pusher 60*a* is positioned closest to the point O1 fixed with the bolt on the side of the rocker shall 27 (L1<L2). As shown in FIG. 18, letter L1 indicates a distance between the point O1 and the center of the pusher 60*a*. Letter L2 indicates a distance between the point O1 and the center of the pusher 80*a*.

Similarly, as shown in FIGS. 4 to 6 and 9 to 11, in attaching the pushers 60*a*, 70*a*, and 80*a* of the rocker shaft cap 130*a* (arranged between the cylinders), the attachment seats 135 are formed in the base portion 131. The attachment seats 135 are arranged immediately above the seat 65 of the low-speed-side cam follower rocker 60, immediately above the seat 75 of the high-speed-side cam follower rocker 70, and immediately above the seat 85 of the exhaust-side cam follower rocker 80 respectively. In each of the attachment seats 135, the holder 139 is placed such that the pressing member 131*a* is projected from the lower side of the rocker shaft cap 130*b*.

The projected pressing members 131*a* abut elastically on the seats 65, 75, and 85, which applies the spring force to the cam follower rocker 60. The spring force presses the cam follower rocker 60 toward the low-speed inlet cam 33. The spring force is applied to the cam follower rocker 70 such that the cam follower rocker 70 is pressed toward the high-speed inlet cam 30. The spring force is applied to the cam follower rocker 80 such that the cam follower rocker 80 is pressed toward the exhaust cam 32.

Therefore, in the pusher attachment structure, the low-speed and high-speed cam follower rockers 60 and 70 are arranged on both sides, and the exhaust cam follower rocker 80 is arranged between the low-speed and high-speed cam follower rockers 60 and 70. As shown in FIG. 18, in the pushers 60*a*, 70*a*, and 80*a* attached to the same rocker shaft cap 130*a*, using the pusher attachment structure and the layout of the seats 65, 75, and 85, the pusher 60*a* is arranged close to the fixing point of the rocker shaft cap 131*a* compared with the pushers 70*a* and 80*a* (smaller than the pusher 60*a* in the setting load). In this case, the pusher 60*a* is positioned closest to the point O2 fixed with the bolts (L3<L4<L5). Letter L3 indicates a distance between the point O2 and the center of the pusher 60*a*. Letter L4 indicates a distance between the point O2 and the center of the pusher 70*a*. Letter L5 indicates a distance between the point O2 and the center of the pusher 80*a*. This structure is adapted in each cylinder 3 of the left bank 7*a*.

Each of the rocker arm modules 20 of the variable valve system 17*b* in the right bank 7*b* has a structure in which the mechanisms and parts which do not contribute to the drive of the valves are removed from the inlet rocker arm module 18 in the left bank 7*a*.

Although not shown, in the structure, the low-speed-side switching structure (mainly including the switching operation portion 40*a* and cam follower rocker 60) is omitted, and the valve drive rocker 35 is always directly driven by the low-speed inlet cam 33. Therefore, the two-stage switching can be performed between the low-speed mode and the high-speed mode while only the high-speed-side switching structure is left.

The exhaust side has a structure in which the mechanisms and parts which do not drive the valves are removed from the exhaust rocker arm module 19 in the left bank 7*a*, i.e., the structure in which only the valve drive rocker 90 is always directly driven by the exhaust cam 32.

The right bank 7*b* also has a structure in which the oil passages 26*a* and 27*a* for cylinder suspension mode are omitted while only the oil passage 26*b* is left. That is, in the structure of the right bank 7*b*, two-stage switching of the valve drive with the high-speed inlet cam 30 and the valve drive with the low-speed inlet cam 33 can be performed in the inlet system, and only the valve drive with the exhaust cam 32 can be performed in the exhaust system.

On the other hand, as shown in FIGS. 1 to 3, an oil control valve 120 (hereinafter referred to as OCV 120) for cylinder suspension mode is provided at the front-portion end of the left bank 7*a*. An oil control valve 121 (hereinafter referred to as OCV 121) for high-speed mode is provided at the rear-portion end of the right bank 7*b*.

The OCVs 120 and 121 are attached to offset spaces generated by the offset between the right and left banks 7*a* and 7*b*. The OCV 120 for cylinder suspension mode, which is attached to the left bank 7*a*, includes a thrust supporting housing 150, a plunger type oil pump 151 (oil pressure supply unit), and a control valve 152. The housing 150 is detachably attached to the bank end while the camshaft end projected from the bank end is inserted into the housing 150. The oil pump 151 attached to the housing 150 is operated by a torque of the camshaft 25. The control valve 152 attached to the housing 150 controls the oil discharged from the oil pump 151. The suction portion of the oil pump 151 is connected to an oil reservoir such as the oil pan (not shown).

The OCV 121 includes a thrust supporting housing 150, an accumulator 151*a*, and an oil control valve portion 152*a*. The housing 150 is detachably attached to the bank end while the camshaft end projected from the bank end is inserted into the housing 150. The accumulator 151*a* is attached to the housing 150, and the oil pressure from an oil pump (piping up the oil from the oil pan: not shown) is accumulated in the accumulator 151*a*. The oil control valve portion 152*a* is attached to the housing 150, and controls the oil discharged from the accumulator 151*a*.

As shown in FIGS. 3, 5, and 7, the discharge portion of the OCV 120 for cylinder suspension mode communicates with the oil passage 27*a* of the rocker shaft 27 (exhaust side) through a passage 153 formed in the cylinder head 6 (left bank 7*a*).

The oil passage 26*a* of the rocker shaft 26 communicates with a return passage 153*a* formed in the cylinder head 6. The discharge portion of the OCV 121 for high-speed mode communicates with the oil passage 26*b* (right bank 7*b*) of the inlet-side rocker shaft (not shown). As shown in FIG. 3, the discharge portion of the OCV 121 communicates with the oil passage 26*b* of the rocker shaft 26 (inlet side) through a relaying pipe member 155, an entrance 156*a* is formed in the cylinder head 6 of the left bank 7*a*, and a passage 156 communicates with the entrance 156*a*. Therefore, the two oil-pressure systems are formed to switch between "high-speed mode" and "cylinder suspension mode".

The OCVs 120 and 121 which are the two oil-pressure supply systems are connected to the control unit 122 (formed by, e.g., the microcomputer). The control unit 122 has a function according to a map previously set dependent on the running state of the automobile. In the function, the OCVs 120 and 121 are "closed" up to a predetermined engine revolution speed range (normal drive state) in which the engine runs normally, only the OCV 121 is "opened" from the high engine revolution speed range exceeding the predetermined revolution speed range, and only the OCV 120 is "opened" in the cylinder suspension range where the stable running conditions are satisfied with no large output.

Therefore, the inlet-side switching mechanisms 69*a* and 79*a* and the exhaust-side switching mechanism 97 are switched among the modes according to the engine running state. Specifically, the inlet-side switching mechanisms 69*a* and 79*a* of the left bank 7*a* are switched among the low-speed mode, the high-speed mode, and the cylinder suspension mode. In the low-speed mode, the displacement of the low-speed inlet cam 33 is transmitted to the valve drive rocker 35 through the low-speed cam follower rocker 60 (for inlet) up to a predetermined engine revolution speed range. In the high-speed mode, instead of the transmission from the low-speed cam follower rocker 60 (for inlet), the displacement of the high-speed inlet cam 30 is transmitted to the valve drive rocker 35 through the high-speed cam follower rocker 70 from a high engine revolution speed range exceeding the predetermined engine revolution speed range. In the cylinder suspension mode, the cam displacement is not transmitted to the valve drive rocker 35 from the low-speed and high-speed cam follower rockers 60 and 70. The low-speed mode and the high-speed mode are the transmission mode.

The exhaust-side switching mechanism 97 is switched between the transmission mode and the cylinder suspension mode. In the transmission mode, the displacement of the exhaust cam 32 is transmitted to the valve drive rocker 90 through the cam follower rocker 80 (for exhaust) up to the high engine revolution speed range. In the cylinder suspension mode, the transmission is disconnected from the cam follower rocker 80.

Obviously the inlet-side switching mechanism (not shown) of the right bank 7*b* is switched between the low-speed mode and the high-speed mode. In the low-speed, the inlet valve is driven by the displacement of the low-speed inlet cam up to the predetermined engine revolution speed range. In the high-speed mode, the inlet valve is driven by the displacement of the high-speed inlet cam from the high engine revolution speed range exceeding the predetermined engine revolution speed range.

Action of the variable valve system 17 will be described with reference to FIGS. 3, 7, and 9 to 12.

It is assumed that a command for performing the low-speed mode is provided to the control unit 122 according to the running state of the automobile. Then, the OCVs 120 and 121 are closed by the control unit 122. That is, the oil-pressure supply system does not act on the oil passages 26*a*, 26*b*, and 27*a* with the oil pressure. The window 44 of the switching operation portion 40*a* (inlet) of the left bank 7*a* is closed, i.e., blocked by the piston 46 (by the elastic force of the compression spring 47) as shown by a solid line of FIG. 9.

As shown by the solid line of FIG. 10, the window 50 of the switching operation portion 40*b* (inlet) is opened (by the elastic force of the compression spring 54). As shown in FIG. 11, the window 100 of the switching operation portion 98 (exhaust) of the left bank 7*a* is blocked by the piston 102 (by the elastic force of the compression spring 103).

Then, in the left bank 7*a*, the cam follower rocker 70 (high speed) is rocked while striking at the air. Because, the cam follower rocker 70 is pressed by the pusher 70. The inlet-side cam follower rocker 60 (low speed) and the exhaust-side cam follower rocker 80 are rocked while striking the pistons 46 and 102 respectively.

The cam follower rockers 60 and 80 are driven while pressed against the inlet earn 30 and the exhaust earn 32 by the elastic force of the valve spring and elastic force of the pusher 60*a* and 80*a* respectively.

Therefore, in the left bank 7*a*, the displacement of the inlet cam 33 (low speed) is transmitted from the valve drive rocker 35 to the stem ends of the inlet valves 13*a* and 13*b* through the rocker arms 37, which drives the inlet valves 13*a* and 13*b*. The displacement of the exhaust cam 32 is transmitted from the connecting arm 95 of the valve drive rocker 90 to the stem ends of the exhaust valves 15*a* and 15*b* through the arms 93, which drives the exhaust valve 15*a* and 15*b*.

On the inlet side of the right bank 7*b*, as with the left bank 7*a*, only the displacement of the low-speed inlet cam transmitted to the valve drive rocker is transmitted to the inlet valve, which drives the inlet valve. On the exhaust side, the displacement of the exhaust cam (not shown) is directly transmitted to the exhaust valve (not shown) through the valve drive rocker (not shown) and the arm (not shown), which drives the exhaust valve.

Therefore, the engine is operated at normal running, i.e., in the low-speed mode brought by the combination of the low-speed cam and the exhaust cam of FIG. 17 up to a predetermined engine revolution speed range.

The control unit 122 opens only the OCV 121 for high-speed mode, when the engine becomes the high revolution speed range exceeding the predetermined revolution speed range due to the running such as acceleration in which the high output is required. This enables the oil pressure to be introduced to the oil passage 26*a* of the left bank 7*a* and the oil passage of the inlet-side rocker shaft of the right bank 7*b* through the pipe member 155.

The oil pressure is applied to the pin 55 of the switching operation portion 40*b* (inlet side) of the left bank 7*a* or right bank 7*b*. Therefore, the piston 53 is driven upward by the pin 55, and the piston 53 blocks the window 50 as shown by the alternate long and two dashes line of FIG. 10.

Then, as shown by the alternate long and two dashes line of FIG. 9, the inlet-side cam follower rockers 70 of the right and left banks 7*a* and 7*b* are rocked while abutting the piston 53.

Because the outer shape of the high-speed inlet cam 30 is set larger than that of the low-speed inlet cam 33, only the displacement of the inlet cam 30 (for high speed) transmitted from the cam follower rocker 70 is transmitted from the valve drive rocker 35 to the inlet valves 13*a* and 13*b*. That is, the inlet valves 13*a* and 13*b* are driven only by the high-speed inlet cam 30. The cam follower rocker 60 is pressed against the inlet cam 60 by the pusher 60*a*.

The displacement of the exhaust cam 32 is transmitted from the cam follower rocker 80 to the connecting arm 95 of the valve drive rocker 90, which continuously drives the exhaust valves 15*a* and 15*b* of the left bank 7*a*. The exhaust valve of the right bank 7*b* is kept running in the same motion as that of the previous low-speed mode. Therefore, the engine switches to the high-speed mode brought by the combination of the high-speed cam and the exhaust cam of FIG. 17.

In the high-speed mode running, the large spring forces of the pushers 70*a* and 80*a* are not required because the reaction forces from the valve springs of the inlet valves 13*a* and 13*b* and the exhaust valves 15*a* and 15*b* act as the forces for pressing the high-speed cam follower rocker 70 and the exhaust cam follower rocker 80.

On the other hand, the large load is set on the spring force of the pusher 60*a* because the cam follower rocker 60 is pressed only by the spring force of the pusher 60*a* during the high revolution speed range.

Therefore, conventionally, because of the easy and inexpensive structure, sometimes the rocker shaft caps 130*a* and 130*b* are bent by the setting spring force of the pusher 60*a*, when simply the pusher 60*a* is arranged parallel or the pusher 60*a* is arranged obliquely in order to arrange the pusher 60*a* along with the pushers 70*a* and 80*a* in the rocker shaft caps 130*a* and 130*b* having the restricted sizes.

When compared with the pushers 70*a* and 80*a*, the pusher 60*a* pressing the cam follower rocker 60 (low speed) is arranged close to the fixing points of the rocker shaft caps 130*a* and 130*b*, i.e., points O1 and O2 where the rocker shaft caps 130*a* and 130*b* are fixed to the cylinder head 6, in both the cases of the rocker shaft cap 130*a* arranged between the cylinders and the rocker shaft cap 130*a* arranged at the end of the line of cylinders.

That is, the pusher 60*a* is arranged as close to the points O1 and O2 as possible. When the pusher 60*a* is arranged close to the points O1 and O2, the pusher 60*a* whose load is larger than those of the pushers 70*a* and 80*a* is supported at the position closest to the fixing points of the rocker shaft caps 130*a* and 130*b*, so that the bending is hardly generated.

Accordingly, in the simple structure in which the pusher 60*a* is arranged close to the fixing point, using the pressing force of the pusher 60*a*, the cam follower rocker 60 can be properly pressed against the inlet cam 33 without generating flutter.

When the automobile enters the running state in which the fuel consumption is reduced, e.g., a medium-speed running area, the control unit 122 performs the cylinder suspension mode (mode for reducing the fuel consumption). That is, the control unit 122 performs the control to open only the OCV 120 for the cylinder suspension mode, which introduces the oil pressure to be introduced from the OCV 120 to the oil passage 27*a* of the rocker shaft 27 (exhaust side) through the passage 153 as shown in FIG. 3. The oil pressure of the oil passage 27*a* is introduced to the oil passage 26*a* of the rocker shaft 26 (inlet side) of the left bank 7*a*.

In the oil passage 26*a*, an area of the passage is hardly increased because the oil passage 26*a* is formed in the rocker shaft 26 along with the oil passage 26*b* (smaller than oil passage 27*a*). Therefore, in the inlet-side rocker arm 18*a*, the switching operation tends to be significantly delayed compared to the exhaust-side rocker arm 18.

As shown in FIG. 3, because the oil passage 27*a* and the oil passage 26*a* are connected to each other with the plural parallel oil passages 140, the oil pressure introduced to the oil passage 27*a* is introduced to the front portion, the intermediate portion, and the rear portion of the oil passage 27*a* through the plural oil passages 140 as shown by the arrows in FIG. 3. Therefore, the oil pressure is rapidly delivered from the oil passage 27*a* to each portion of the oil passage 26*a* in which there is the restriction of the small area of the passage.

Accordingly, the window 44 of the inlet-side switching operation portion 40*a* is opened by the oil pressure (by raising the piston 46) at substantially the same timing as the exhaust side, i.e., substantially the same timing at which the window 100 of the exhaust-side switching operation portion 40*b* is opened by raising the piston 104. The window 50 is opened because the oil pressure does not act on the switching operation portion 40*b* (FIG. 10). On the exhaust side, as shown in FIG. 10, the piston 104 of the switching operation portion 98 is driven upward by raising the pin 104. This enables the window 100 of the switching operation portion 98 to be opened.

At substantially the same time, the cam follower rockers 60 (inlet: low speed) and the cam follower rocker 80 (exhaust) in the left bank 7*a* are switched to the rocking drive in which the cam follower rockers 60 and 80 strike the air. The drive force for driving the valve is not transmitted to the valve drive rockers 35 and 90 (inlet and exhaust). Accordingly, as shown in FIG. 12, because the slippers 41 and 96 of the valve drive rockers 35 and 90 slide continuously on the cam surface of the non-lift cam 31, and thereby the inlet valves 13*a* and 13*b* and the exhaust valves 15*a* and 15*b* are maintained in the closed state (cylinder suspension mode).

At this point, in the inlet variable valve devices 20 and the exhaust variable valve device 21 of the right bank 7*b*, as with the low-speed mode, the displacement of the low-speed inlet cam is continuously transmitted to the inlet valve, and the displacement of the exhaust cam is continuously transmitted to the exhaust valve, which enters the cylinder suspension mode in which the cylinders (cylinders of the left bank 7*a*) are partially suspended.

When the engine is switched from the cylinder suspension mode to the low-speed mode or high-speed mode, the cam follower rockers 60 and the cam follower rockers 80 of the left bank 7*a* are switched at substantially the same time.

Thus, the use of the ladder-shaped oil passage 146 improves the delay of the rocker arm 18*a* (inlet side) operated by the oil pressure of the oil passage 26*a*, which dramatically improves the switching property of the rocker arm 18*a*.

Accordingly, in the cylinder suspension mode, the fluctuations of the start timing and end timing caused by the restriction of the oil passage 26*a* can be suppressed, and the generation of the noise and vibration caused by the fluctuation can also be suppressed. Furthermore, the range of the cylinder suspension mode (second mode) can be expanded because of the suppression of the fluctuation.

The oil passages 26*a* and 27*a* formed in the rocker shafts 26 and 27 communicate with each other in the ladder shape via the plural oil passages 140 (relay oil passage), and the oil pressure is rapidly delivered to each portion of the oil passages 26*a* and 27*a*, so that the rocker arms 18*a* and 18*b* are switched at substantially the same time by the oil pressure acting on the oil passages 26*a* and 27*a*.

Accordingly, the delay of the switching response and fluctuation of the switching are suppressed in the rocker arm 18*a*. Particularly, the improvement of the switching response prevents endurance reliability from being worsened. The endurance reliability is worsened by the development of wear in the switching portion, because the large load is applied on the switching portion by the valve lift which is in the incompletely-switched state.

Because the engine running state is greatly changed in the switching to and from the cylinder suspension mode in which the lift cam is greatly changed, it is necessary that the switching be synchronized to control of an air fuel ratio and ignition timing. In the case of the small fluctuation of the switching response, the switching can be synchronized to control of an air fuel ratio and ignition timing. Therefore, the large fluctuation in combustion including misfire is suppressed, and low fuel consumption is achieved while the degradation of the drivability or the exhaust gas is suppressed.

In the structure in which the ladder-shaped oil passage 146 is formed by utilizing the rocker shaft caps 130*a* and 130*b*, the ladder-shaped oil passage 146 can be formed at low cost with the simple structure, when compared with the structure in which a component is separately produced and attached to the cylinder block 6 or the structure in which all the oil passages are formed only by the processing of the cylinder head 6.

A variable valve device according to a second embodiment of the invention will be described with reference to FIG. 20. The present embodiment is a modified example of the first embodiment. In the layout in which pusher 60*a* is arranged between two fixing points O3 and O4 where the rocker shaft cap 130*a* fixing the inlet rocker shaft 26 and the exhaust rocker shaft is fixed with the bolts, the pusher 60*a* is arranged while brought closer to one of the points (in this case, the point O3 on the side of the rocker shaft 27) rather than the pushers 70*a* and 80*a* (L8<L6<L7). The same effect as the first embodiment is also obtained in the second embodiment.

Figure 20:
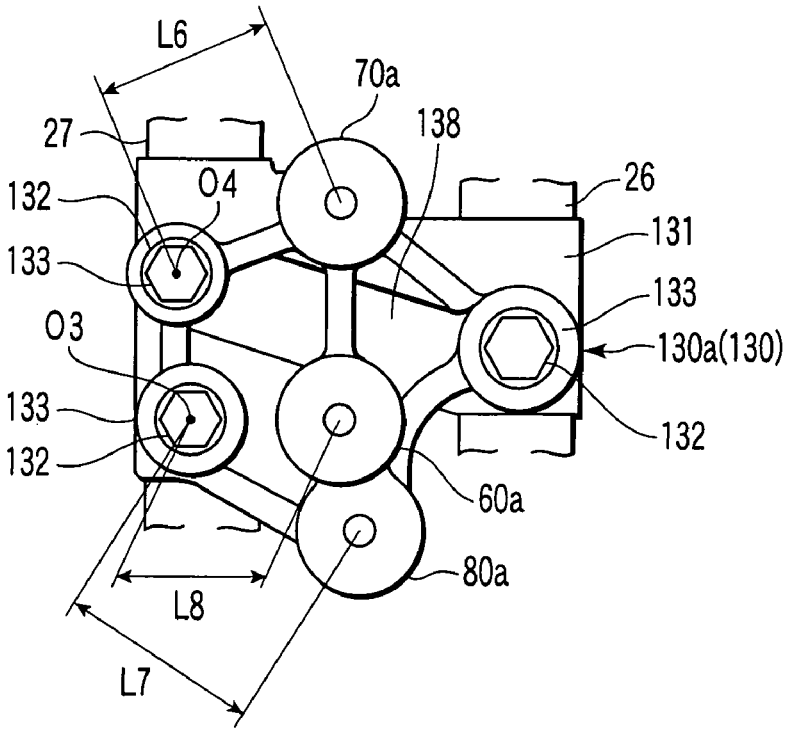
FIG. 20 is a plan view showing a main part of a variable valve device according to a second embodiment of the invention.

However, in FIG. 20, the same components as those in the first embodiment are designated by the same numerals, and the description is omitted. Letter L8 indicates a distance between the point O3 and the center of the pusher 60*a*. Letter L6 indicates a distance between the point O4 and the center of the pusher 70*a*. Letter 7 indicates a distance between the point O3 and the center of the pusher 80*a*.

The invention is not limited to the above embodiments, but various modifications could be made without departing from the scope of the invention. In the above embodiments, the invention is applied to the V-type engine. However, the invention may be applied to in-line type engines whose arrangement of the cylinders is different from that of the V-type engine and DOHC-type engines in which the rocker shaft is divided into the inlet rocker shaft and the exhaust rocker shaft (not shown).

In the above embodiments, the first mode is set to the cylinder suspension mode. Alternatively, the first mode may be set to the high-speed mode. In the above embodiments, the invention is applied to the engine equipped with the three-mode variable valve device on the inlet side. Alternatively, the invention may be applied to the engine equipped with the three-mode variable valve device on the exhaust side or the engine equipped with the three-mode variable valve devices on both the inlet side and the exhaust side. The invention may also be applied to the engine equipped with the two-mode variable valve devices on both the inlet side and the exhaust side.

For example, the rocker shaft caps are fixed by the fixing structure in which the exhaust side is fixed by the two-point bolt fixing and the inlet side is fixed by the one point bolt fixing. The pusher biasing the low-speed cam follower rocker is arranged close to the fixing points explained above. The invention is not limited above. Alternatively, the pusher may be arranged close to the fixing point of the rocker shaft cap fixed by another fixing structure or another fixing unit.

In the embodiments, the low- and high-speed cams are provided only on the inlet side. Alternatively, the low- and high-speed cams are provided only on the exhaust side or on both the inlet side and exhaust side, and the pusher biasing the low-speed cam follower rocker may be arranged while brought closer to the fixing point rather than other pushers.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve device for an internal combustion engine comprising:

a camshaft which is rotatably provided in a body of an internal combustion engine;

a pair of rocker shafts which is arranged next to the camshaft;

an inlet valve which is driven by rotation of the camshaft;

an exhaust valve which is driven by the rotation of the camshaft;

a first hydraulic rocker arm which is rockably supported by one of the rocker shafts, and is able to switch drive of one of the inlet valve and the exhaust valve at least between a normal drive state and a first mode which is different from the normal drive state;

a second hydraulic rocker arm which is rockably supported by the other rocker shaft, and is able to switch drive of the other of the inlet valve and the exhaust valve at least between the normal drive state and the first mode which is different from the normal drive state;

a first switching oil passage which is formed along an axial direction in one of the rocker shafts, the first rocker arm being switched to the first mode by applying oil pressure to the first rocker arm through the first switching oil passage; and a second switching oil passage which is formed along an axial direction in the other rocker shaft, the second rocker arm being switched to the first mode by applying oil pressure to the second rocker arm though the second switching oil passage, a plurality of relay oil passages communicating the first switching oil passage and the second switching oil, the first switching oil passage, the second switching oil passage, and the relay passages being formed in a ladder shape each relay oil passage releasing oil pressure in the second switching oil passage to the first switching oil passage.

2. The variable valve device for an internal combustion engine according to claim 1, further comprising:

a third switching oil passage which is formed next to the first switching oil passage in at least one of the rocker shafts, the first rocker arm being switched to a second mode by applying the oil pressure to the first rocker am though the third switching oil passage, the second mode being different from the normal drive state and the first mode.

3. The variable valve device for an internal combustion engine according to claim 1, wherein a diameter of the second switching oil passage is larger than a diameter of the first switching oil passage.

4. A variable valve device for an internal combustion engines, comprising:

a camshaft which is rotatably provided in a body of an internal combustion engine;

a pair of rocker shafts which is arranged next to the camshaft, each of the pair of rocker shafts being fixed to the internal combustion engine by a rocker shaft cap having a shape in which the rocker shaft cap spreads across the rocker shafts;

an inlet valve which is driven by rotation of the camshaft;

an exhaust valve which is driven by the rotation of the camshaft;

a first hydraulic rocker arm which is rockably supported by one of the rocker shafts, and is able to switch drive of one of the inlet valve and the exhaust valve at least between a normal drive state and a first mode which is different from the normal drive state;

a second hydraulic rocker arm which is rockably supported by the other rocker shaft, and is able to switch drive of the other of the inlet valve and the exhaust valve at least between the normal drive state and the first mode which is different from the normal drive state;

a first switching oil passage which is formed along an axial direction in one of the rocker shafts, the first rocker arm being switched to the first mode by applying oil pressure to the first rocker arm through the first switching oil passage;

a second switching oil passage which is formed along an axial direction in the other rocker shaft, the second rocker arm being switched to the first mode by applying oil pressure to the second rocker arm through the second switching oil passage; and a plurality of relay oil passages communicating the first switching oil passage and the second switching oil passage, the first switching oil passage, the second switching oil passage, and the relay passages being formed in a ladder shape, the relay of oil passage being formed in the rocker shaft cap.

5. The variable valve device for an internal combustion engine according to claim 4, wherein an inlet cam and an exhaust cam are provided in the camshaft, the inlet cam driving the inlet valve while abutting the first rocker arm, the exhaust cam driving the exhaust valve while abutting the second rocker arm, and a plurality of pushers are arranged in the rocker shaft cap, the pushers suppressing the first rocker arm and the second rocker arm against the cams with elastic force.

6. The variable valve device for an internal combustion engine according to claim 5, wherein the inlet cam includes a low-speed inlet cam and a high-speed inlet cam, the first rocker arm includes:

an inlet valve drive rocker which drives the inlet valve;

a pair of inlet cam follower rockers which follow the low-speed and high-speed inlet cams, respectively; and an inlet switching unit which is able to perform switching between the normal drive state and second mode and the first mode, displacement of the low-speed inlet cam being transmitted to the inlet valve drive rocker though one of the inlet cam follower rockers up to a predetermined revolution speed range of the internal combustion engine in the normal drive state, displacement of the high-speed inlet cam being transmitted to the inlet valve drive rocker through the other inlet cam follower rocker while the transmission is disconnected from one of the inlet cam follower rockers from a high engine revolution speed range exceeding the predetermined revolution speed range in the second mode, the cam displacement being not transmitted from the low-speed and high-speed inlet cam follower rockers to the inlet valve drive rocker in the first mode, the second rocker arm includes:

an exhaust valve drive rocker which drives the exhaust valve;

a pair of exhaust cam follower rockers which follow the exhaust cam; and an exhaust switching unit which is able to perform switching between the normal drive state and the first mode, displacement of the exhaust cam being transmitted to the exhaust valve drive rocker through the exhaust cam follower rocker in the normal drive state, the transmission being disconnected from the exhaust valve drive rocker in the first mode, and a pusher which presses one of the inlet cam follower rockers is arranged while brought closer to a fixing point of the rocker shaft cap rather than a pusher which presses the exhaust cam follower rocker.

7. The variable valve device for an internal combustion engine according to claim 6, wherein a plurality of pushers are provided in the rocker shaft cap, the pushers pressing one of the inlet cam follower rockers, the other inlet cam follower rocker, and the exhaust cam follower rocker against the low-speed inlet cam, the high-speed inlet cam, and the exhaust cam with elastic force, respectively, and the pusher which presses one of the inlet cam follower rockers is arranged while brought closer to a fixing point of the rocker shaft cap rather than the pushers which press the other inlet cam follower rocker and the exhaust cam follower rocker.

8. The variable valve device for an internal combustion engine according to claim 4, wherein a diameter of the second switching oil passage is larger than a diameter of the first switching oil passage.

* * * * *